US006827423B1

(12) United States Patent
Katakura et al.

(10) Patent No.: US 6,827,423 B1
(45) Date of Patent: Dec. 7, 2004

(54) LIQUID JETTING APPARATUS, METHOD OF DRIVING THE SAME, COMPUTER-READABLE RECORDING MEDIUM STORING THE METHOD AND IMAGE RECORDING APPARATUS INCORPORATING THE SAME

(75) Inventors: Takahiro Katakura, Nagano (JP); Yuichi Nakamura, Nagano (JP); Teruhito Kojima, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/564,862

(22) Filed: May 4, 2000

(30) Foreign Application Priority Data

| | | |
|---|---|---|
| May 6, 1999 | (JP) | 11-126077 |
| Dec. 24, 1999 | (JP) | 11-366341 |
| Apr. 13, 2000 | (JP) | 2000-112062 |
| Apr. 27, 2000 | (JP) | 2000-126770 |

(51) Int. Cl.[7] ..... B41J 2/21
(52) U.S. Cl. ..... 347/40; 347/43; 347/100
(58) Field of Search ..... 347/12, 40, 15, 347/41, 43, 98, 95, 100

(56) References Cited

U.S. PATENT DOCUMENTS

| | | | | | |
|---|---|---|---|---|---|
| 4,746,935 | A | * | 5/1988 | Allen | 347/43 |
| 5,568,169 | A | * | 10/1996 | Dudek et al. | 347/43 |
| 5,614,931 | A | | 3/1997 | Koike et al. | 347/43 |
| 5,745,140 | A | | 4/1998 | Stoffel et al. | 347/100 |
| 5,767,876 | A | * | 6/1998 | Koike et al. | 347/43 |
| 5,784,078 | A | * | 7/1998 | Furuya | 347/41 |
| 5,825,377 | A | * | 10/1998 | Gotoh et al. | 347/43 |
| 5,992,971 | A | * | 11/1999 | Takahashi et al. | 347/43 |
| 6,030,065 | A | * | 2/2000 | Fukuhata | 347/15 |
| 6,092,887 | A | * | 7/2000 | Tanino et al. | 347/40 |
| 6,128,098 | A | * | 10/2000 | Kamada et al. | 347/40 |
| 6,149,260 | A | * | 11/2000 | Minakuti | 347/15 |
| 6,264,305 | B1 | * | 7/2001 | Inui et al. | 347/40 |

FOREIGN PATENT DOCUMENTS

| | | | | |
|---|---|---|---|---|
| EP | 0 610 096 A2 | | 8/1994 | B41J/2/205 |
| EP | 0 739 736 A2 | | 10/1996 | |
| EP | 0 750 995 A1 | | 1/1997 | |
| EP | 0 887 194 A2 | | 12/1998 | |
| EP | 0 962 323 A1 | | 12/1999 | B41J/2/205 |
| EP | 0 982 139 A1 | | 3/2000 | B41J/2/21 |
| JP | 358012764 | * | 1/1983 | 347/43 |
| JP | 6-24005 A | | 2/1994 | |
| JP | 8-290647 A | | 11/1996 | |
| JP | 8-336979 A | | 12/1996 | |
| JP | 9-1832 A | | 1/1997 | |
| JP | 9-85964 A | | 3/1997 | |
| JP | 9-187940 A | | 7/1997 | |
| JP | 9-226121 A | | 9/1997 | |
| JP | 9-254414 A | | 9/1997 | |
| JP | 10 -34914 | | 2/1998 | |
| JP | 10-151769 A | | 6/1998 | |
| JP | 2994884 | | 10/1999 | B41J/2/21 |
| WO | WO 98/22289 | | 5/1998 | |

* cited by examiner

*Primary Examiner*—Lamson Nguyen
(74) *Attorney, Agent, or Firm*—Sughrue Mion, PLLC

(57) ABSTRACT

Three nozzle arrays respectively including a plurality of nozzle orifices 23 are provided. Two of the nozzle arrays are divided into a plurality of nozzle blocks NB1 to NB6. One of the nozzle arrays is provided as a unit nozzle block NB7. Different kinds of inks to be ejected are allocated with respect to each nozzle blocks. Dye-family colored inks are ejected from the respective divided nozzle blocks. Pigment-family black ink is ejected from the unit nozzle block.

48 Claims, 17 Drawing Sheets

LIQUID JETTING APPARATUS, METHOD OF DRIVING THE SAME, COMPUTER-READABLE RECORDING MEDIUM STORING THE METHOD AND IMAGE RECORDING APPARATUS INCORPORATING THE SAME

BACKGROUND OF THE INVENTION

The present invention relates to a liquid jetting apparatus for jetting a liquid, such as ink, glue or manicure, an image recording apparatus incorporating the liquid jetting apparatus and a method of driving the liquid jetting apparatus.

A related technique will now be described such that an ink jet recording head and an ink jet recording apparatus incorporating the recording head are described.

To perform both color recording and monochrome recording, an ink jet recording head structured to be capable of discharging ink in different colors, such as black ink, cyan ink, magenta ink and yellow ink and an ink jet recording apparatus having the recording head mounted thereon have been suggested. A portion of the recording apparatuses is arranged to use high permeable ink, such as dye-type ink, exhibiting excellent permeability into recording paper in order to prevent mixture of ink and improve the quality of a color image.

The foregoing structure, however, suffers from a problem in that the quality of a monochrome image, such as a document, deteriorates in spite of capability of improving the quality of a color image. That is, high permeable ink has an advantage that occurrence of color mixture can be prevented because high permeable ink quickly permeates into recording paper. High permeable ink encounters a problem of spreading in the radial direction of the dot. Therefore, the color of the edge portion of the recorded dot gradually fades toward the outside. When characters or the like are recorded, the boundary portion is blurred.

To record dots each having a sharp edge, it is preferable that low permeable ink is used which has a low degree of permeation into recording paper as compared with high permeable ink. When a plurality of recording heads are mounted to correspond to the types of ink, the apparatus becomes too complicated and the size is enlarged excessively.

Since the characteristics of the recording heads must be made coincide with one another, a complicated adjustment operation must be performed. Therefore, development of a small-size recording head which is capable of discharging plural types of ink having different physical properties, including the permeation, has been required.

SUMMARY OF THE INVENTION

In view of the foregoing, an object of the present invention is to provide a liquid jetting apparatus which is capable of discharging plural types of liquids having different physical properties and which permits size reduction, an image recording apparatus incorporating the liquid jetting apparatus, a method of operating the liquid jetting apparatus, and a computer-readable recording medium storing the method.

In order to achieve the above object, according to the first aspect of the invention, there is provided a liquid jetting apparatus comprising:

a first group of nozzles for respectively ejecting a first kind of liquid droplet;

a second group of nozzles for respectively ejecting the first kind of liquid droplet; and a third group of nozzles for respectively ejecting a second kind of liquid droplet having different physical property from the first kind of liquid, wherein the amount of liquid droplet ejected from the nozzle in the first group and the amount of liquid droplet ejected from the nozzle in the second group are different from each other.

Note that the "physical properties" of the liquid means characteristics including permeation, viscosity, density, surface tension or the like.

According to the second aspect of the invention, the amount of liquid droplet ejected from the nozzle in the second group and the amount of liquid droplet ejected from the nozzle in the third group are identical with each other.

According to the third aspect of the invention, the nozzles in the first group include a plurality of nozzle arrays.

According to the fourth aspect of the invention, the nozzles in the second group and the third group respectively include at least one nozzle array. The nozzle array in the second group and the nozzle array in the third group are arranged adjacent to one another.

According to the fifth aspect of the invention, there is also provided a liquid jetting apparatus comprising:

a plurality of nozzle arrays; and a plurality of divided nozzle arrays defined by dividing at least one of the nozzle arrays into a plurality of nozzle blocks, wherein liquids ejected from the respective divided nozzle arrays have different physical properties from each other.

According to the sixth aspect of the invention, the divided nozzle arrays are defined with respect to at least two of the nozzle arrays.

According to the seventh aspect of the invention, the nozzles in one nozzle array including the divided nozzle arrays are arranged so as to form a zigzag configuration with respect to the nozzles in another nozzle array including the divided nozzle arrays.

According to the eighth aspect of the invention, both ends of the respective nozzle arrays are dummy nozzles which are not subjected to the liquid ejection.

According to the ninth aspect of the invention, the liquid jetting apparatus further comprises:

pressure chambers for generating pressure to eject the liquid from the associated nozzles; and a dummy pressure chamber which is not subjected to the liquid ejection is provided between the nozzles in the respective adjacent divided nozzle arrays.

According to the tenth aspect of the invention, at least one of the nozzle arrays is not divided into the divided nozzle arrays.

According to the eleventh aspect of the invention, at least two of the nozzle arrays are not divided into the divided nozzle arrays. The nozzles in one nozzle array not including the divided nozzle arrays are arranged so as to form a zigzag configuration with respect to the nozzles in another nozzle array not including the divided nozzle arrays.

According to the twelfth aspect of the invention, there is also provided an image recording apparatus for recording an ink image on a recording medium, comprising the liquid jetting apparatus of the first to fourth aspects. Here, the first kind of liquid is a first kind of ink and the second kind of liquid is a second kind of ink.

According to the thirteenth aspect of the invention, the second kind of ink has a higher permeability with respect to the recording medium than the first kind of ink.

According to the fourteenth aspect of the invention, there is also provided an image recording apparatus for recording an ink image on a recording medium, comprising the liquid jetting apparatus of the fifth to eleventh aspects. Here, the divided nozzle arrays are composed of a first divided nozzle block for ejecting a yellow ink droplet, a second divided nozzle block for ejecting a magenta ink droplet and a third nozzle block for ejecting a cyan ink droplet.

According to the fifteenth aspect of the invention, the second nozzle block is arranged between the first nozzle block and the third nozzle block.

According to the sixteenth aspect of the invention, there is also provided an image recording apparatus for recording an ink image on a recording medium, comprising the liquid jetting apparatus of the sixth to eleventh aspects. Here, the liquid ejected from a divided nozzle array in one nozzle array is a first kind of ink, and the liquid ejected from a divided nozzle array in another nozzle array adjacent to the divided nozzle array for ejecting the first kind of ink is a second kind of ink. The first kind of ink and the second kind of ink are homochromatic. The first kind of ink has a higher color density than the second kind of ink.

According to the seventeenth aspect of the invention, there is also provided an image recording apparatus recording an ink image on a recording medium, comprising the liquid jetting apparatus of the fifth and ninth aspects. Here, a first kind of ink and a second kind of ink having a higher permeability with respect to the recording medium than the first kind of ink are allocated as the liquid ejected from the respective nozzle blocks.

According to the eighteenth aspect of the invention, there is also provided an ink image on a recording medium, comprising the liquid jetting apparatus of the tenth or eleventh aspect. Here, the respective divided nozzle array eject either one of a first kind of ink or a second kind of ink having a higher permeability with respect to the recording medium than the first kind of ink. The respective nozzle arrays not including the divided nozzle array eject another one of the first kind of ink and the second kind of ink.

According to the ninth aspect of the invention, at least one of the nozzle arrays not including the divided nozzle arrays ejects a black ink droplet.

According to the twelfth aspect of the invention, at least one nozzle array is arranged between the nozzle array for ejecting the black ink droplet and a nozzle array including a divided nozzle arrays for ejecting an yellow ink droplet.

According to the twenty-first aspect of the invention, the first kind of ink includes a pigment-family ink and the second kind of ink includes a dye-family ink.

According to the twenty-second aspect of the invention, the pigment-family ink is a black ink and the dye-family ink is a colored ink.

According to the twenty-third aspect of the invention, the image recording apparatus further comprises a capping member for sealing a surface on which the nozzles are formed. The capping member is partitioned in accordance with the kind of ink ejected from the nozzles to be sealed.

According to the twenty-fourth aspect of the invention, there is also provided a method of driving a liquid jetting apparatus having nozzles, comprising the steps of:

defining a first group of nozzles for respectively ejecting a first kind of liquid droplet;

defining a second group of nozzles for respectively ejecting the first kind of liquid droplet;

defining a third group of nozzles for respectively ejecting a second kind of liquid droplet having different physical property from the first kind of liquid; and setting the amount of liquid droplet ejected from the nozzle in the first group so as to be different from the amount of liquid droplet ejected from the nozzle in the second group are different from each other.

According to the twenty-fifth aspect of the invention, the driving method further comprises the step of setting permeabilities with respect to an object to which the liquid is jetted of the first kind of liquid and the second kind of liquid so as to be different from each other.

According to the twenty-sixth aspect of the invention, the amount of liquid droplet ejected from the nozzle in the first group is greater than the amount of liquid droplet ejected from the nozzle in the second group.

According to the twenty-seventh aspect of the invention, the first nozzle group and the second nozzle group are used when only the first kind of liquid is ejected. The second nozzle group and the third nozzle group are used when both of the first kind of liquid and the second kind of liquid are ejected.

Accordingly, since the quantity of first liquid can be determined to meet the purpose of the recording operation, a single liquid jetting apparatus can be adapted to a variety of purposes. Thus, a necessity of providing the liquid jetting apparatuses for the purposes can be eliminated. Therefore, the structure can be simplified and the size reduction is permitted.

According to the twenty-eighth aspect of the invention, the third nozzle group includes a plurality of nozzle arrays. The second kind of liquid includes a plurality kinds of liquids having physical properties are different with each other, which are allocated with respect to the respective nozzle arrays.

Accordingly, plural types of liquids having different physical properties can be ejected from different nozzle blocks. Since the nozzle array is divided into a plurality of nozzle blocks, one nozzle array is able to discharge plural types of liquids. As a result, even a single liquid jetting apparatus can be adapted to a variety of purposes. As a result, the necessity of providing liquid jetting apparatuses for individual purposes can be eliminated.

According to the twenty-ninth aspect of the invention, there is provided a computer-readable recording medium for recording a program to cause a computer to function as:

a first ejection controller for controlling a liquid jetting apparatus comprising a first group of nozzles and a second group of nozzles for jetting a first kind of liquid droplet and a third group of nozzles for jetting a second kind of liquid droplet having a different physical property from the first kind of liquid such that the amount of liquid droplet ejected from the nozzle in the first group and the amount of liquid droplet ejected from the nozzle in the second group are different from each other.

According to the thirtieth aspect of the invention, the amount of liquid droplet ejected from the nozzle in the first group is greater than the amount of liquid droplet ejected from the nozzle in the second group.

According to the thirty-first aspect of the invention, the recording medium causes the computer to further function as:

a second ejection controller for controlling the liquid jetting apparatus such that the nozzles in the first and second groups are used when only the first kind of liquid is ejected; and the nozzles in the second and third groups are used when the first and second kinds of liquids are ejected.

Here, the computer is caused to function as at least one of the first ejection controller and the second ejection controller.

According to the thirty-second aspect of the invention, there is provided a computer-readable recording medium for recording a control program to cause a computer to function as:

a liquid-kind recognizer for recognizing respective ink kinds ejected from the nozzles in the first, second and third groups of the liquid jetting apparatus of the first to fourth aspects of the invention;

a drive waveform selector for selecting a waveform of a drive signal for driving the liquid jetting apparatus to eject the liquid droplet, which is optimum with respect to each ink kind recognized by the liquid-kind recognizer; and a ejection controller for ejecting the liquid droplet using the drive signal selected by the drive waveform selector.

According to the thirty-third aspect of the invention, there is provided a computer-readable recording medium for recording a control program to cause a computer to function as:

a liquid-kind recognizer for recognizing respective ink kinds ejected from the nozzles in each nozzle block of the liquid jetting apparatus of the fifth to eleventh aspects of the invention;

a drive waveform selector for selecting a waveform of a drive signal for driving the liquid jetting apparatus to eject the liquid droplet, which is optimum with respect to each ink kind recognized by the liquid-kind recognizer; and a ejection controller for ejecting the liquid droplet using the drive signal selected by the drive waveform selector.

DETAILED DESCRIPTION OF THE PREFERRED EMBODIMENTS

Embodiments of the present invention will now be described. In this embodiment, an ink jet recording head will be described as an example. An ink jet recording apparatus will now be described as an image recording apparatus.

Figure 1:
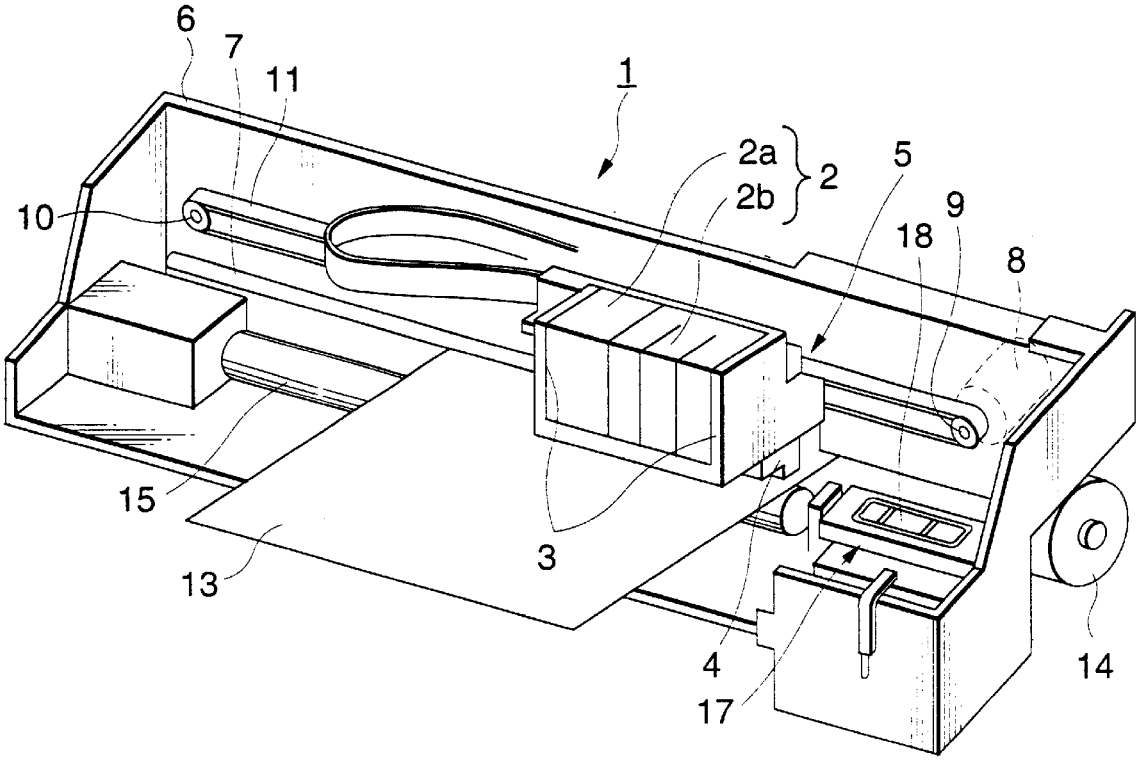
FIG. 1 is a perspective view showing the structure of a printer.

FIG. 1 is a diagram showing the overall structure of an ink jet printer 1 (hereinafter called a printer 1) which is a representative ink jet recording apparatus. The printer 1 incorporates a carriage 5 to which a recording head 4 is joined. The carriage 5 has a cartridge holder 3 for holding a plurality of ink cartridges 2 (2*a* and 2*b*).

The carriage 5 is movably joined to a guide member 7 arranged in a housing 6. A head scanning mechanism reciprocates the carriage 5 along the guide member 7.

The ink cartridges 2 according to this embodiment consists of a black cartridge 2*a* in which black ink is accumulated and a color cartridge 2*b* in which color ink (colored ink) is accumulated. The color cartridge 2*b* is sectioned into three ink chambers in which cyan ink, magenta ink and yellow ink, respectively, are accumulated. Note that ink is an example of liquid according to the present invention.

Figure 5:
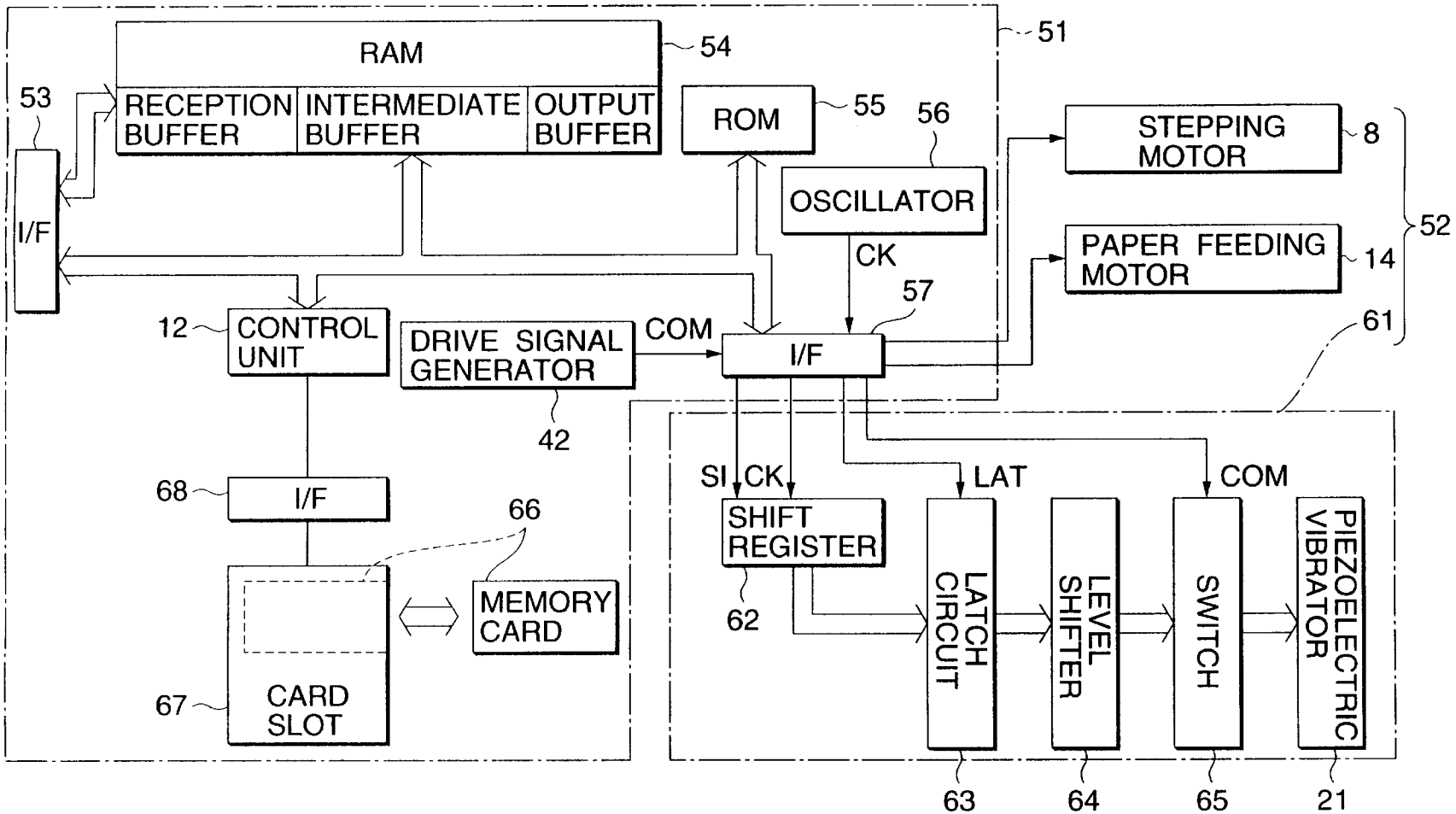
FIG. 5 is a block diagram showing an electric operation system for the printer.

The head scanning mechanism incorporates a stepping motor 8 disposed at a lateral end of the housing 6; a drive pulley 9 connected to the rotational shaft of the stepping motor 8; an idle pulley 10 disposed at another lateral end of the housing 6; a timing belt 11 arranged between the drive pulley 9 and the idle pulley 10 and connected to the carriage 5; and a control unit 12 (see FIG. 5) for controlling the rotation of the stepping motor 8. The head scanning mechanism is structured such that the stepping motor 8 is rotated to reciprocate the carriage 5, that is, the recording head 4, in the widthwise direction of the recording paper 13 (that is, in the main scanning direction).

The printer 1 incorporates a paper feeding mechanism for feeding recording paper 13 in a sub-scanning direction perpendicular to the main scanning direction. The paper feeding mechanism incorporate a paper-feeding motor 14, a paper-feeding roller 15 which is rotated by the paper-feeding motor 14; and a control unit 12 for controlling the rotation of the paper-feeding motor 14. In synchronization with the main scanning operation of the recording head 4, the paper feeding mechanism sequentially feeds the recording paper 13 (which is an example of the recording medium and as well as an example a subject to which ink is jetted).

A standby position and a home position are defined in an end region in the movable range for the carriage 5 (the recording head 4) at a position outer than the recording region. A capping mechanism 17 for sealing a nozzle plate 16 (see FIG. 2) of the recording head 4 from a lower position is disposed at the foregoing position. The capping mechanism 17 incorporates a capping member 18 made of an elastic material, such as rubber, and formed into a tray shape; and a vertically moving portion (not shown) for vertically moving the capping member 18.

The capping member 18 has a recess formed in the upper surface thereof. A moisture retention member made of felt or the like is joined to the recess. Therefore, when the nozzle plate 16 is capped by the capping member 18, a high temperature of the inside portion of the cap can be maintained by the moisture retention member. Therefore, evaporation of solvent for ink from a nozzle orifices 19 (see FIG. 2) can be prevented.

Figure 2:
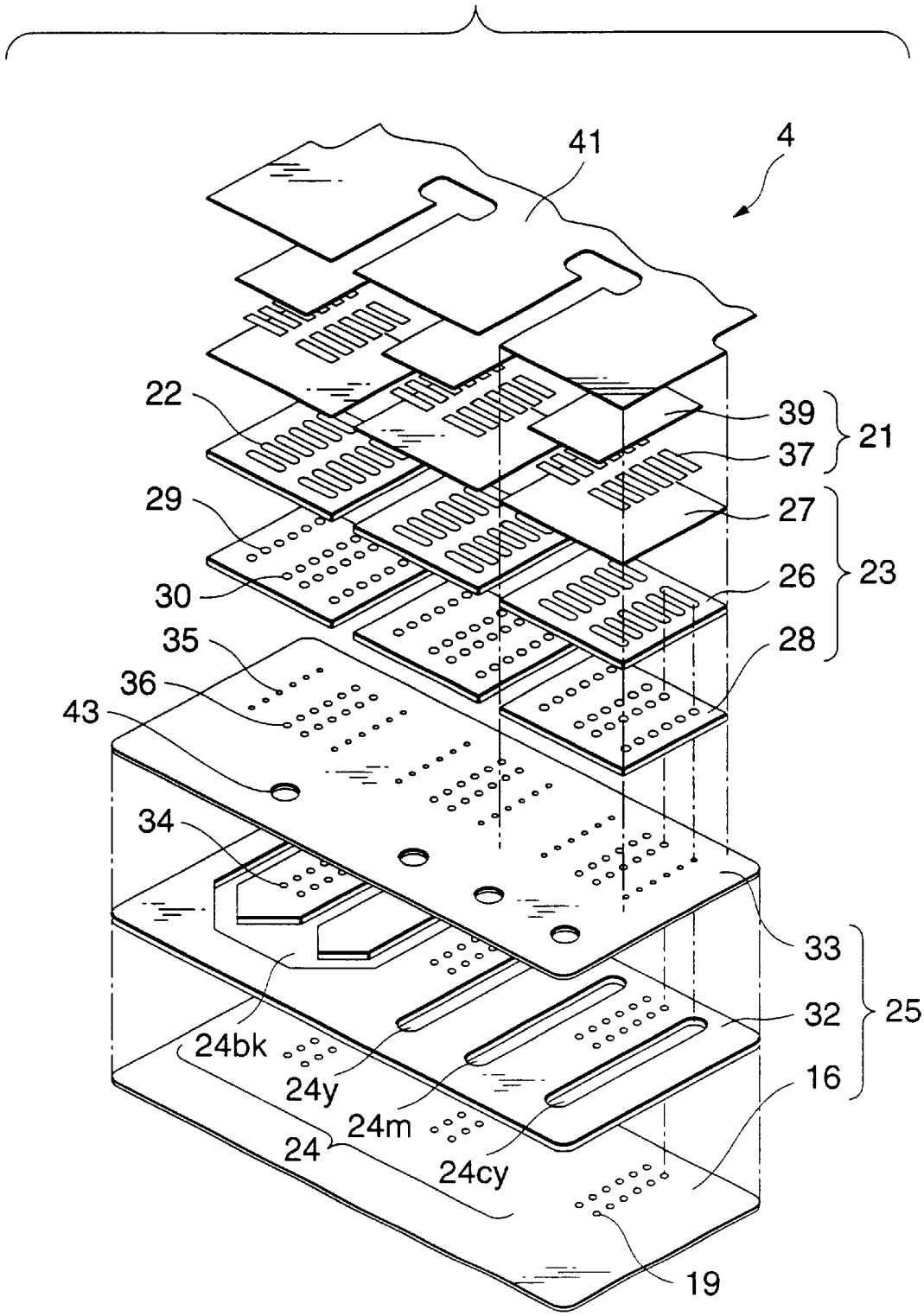
FIG. 2 is an exploded perspective view showing a recording head.
Figure 3:
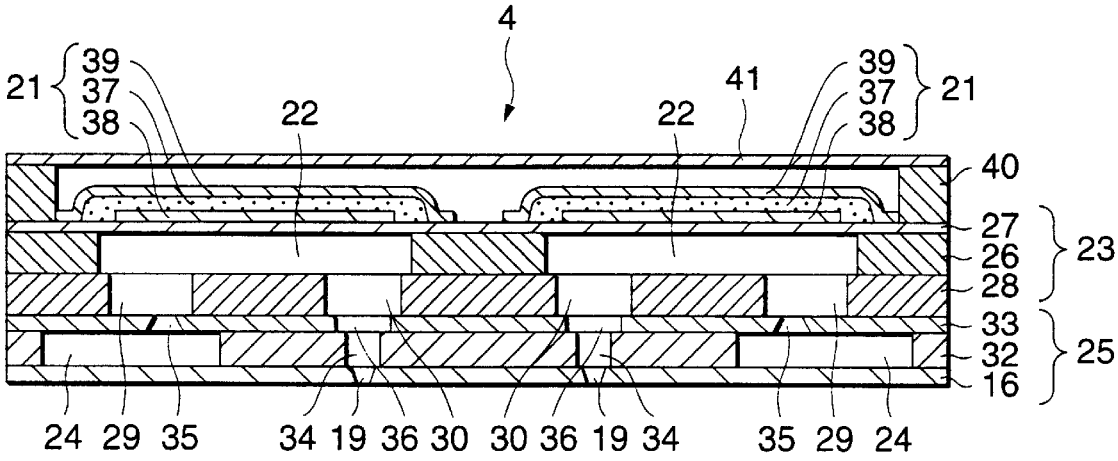
FIG. 3 is a cross sectional view showing the recording head.

Then, the recording head 4 will now be described. The recording head 4 shown in FIGS. 2 and 3 is a recording head 4 having a piezoelectric vibrator 21 in a deflection oscillation mode joined thereto. The recording head 4 incorporates an actuator unit 23 having a plurality of pressure chambers 22 formed therein; a channel unit 25 having nozzle orifices 19 and common ink reservoirs 24 formed therein; and a piezoelectric vibrator 21. The channel unit 25 is joined to the front surface of the actuator unit 23 which faces the recording paper 13. Moreover, the piezoelectric vibrator 21 is joined to the rear surface of the actuator unit 23.

The actuator unit 23 incorporates a pressure chamber formation plate 26 having a hollow portion which is formed into a pressure chamber 22; a vibration plate 27 joined to the rear surface of the pressure chamber formation plate 26 and arranged to close a rear opening of the hollow portion which is formed into the pressure chamber 22; and a cover 28 joined to the front surface of the pressure chamber formation plate 26. The cover 28 has a first ink passage 29 for establishing the communication between the common ink reservoirs 24 and the pressure chamber 22; and a second ink passage 30 for establishing the communication between the pressure chamber 22 and the nozzle orifices 19.

The channel unit 25 incorporates a reservoir formation plate 32 having an empty portion which is formed into the common ink reservoirs 24; a nozzle plate 16 having a plurality of nozzle orifices 19 formed therein and joined to the front surface of the reservoir formation plate 32; and a port formation plate 33 joined to the rear surface of the reservoir formation plate 32. Moreover, the reservoir formation plate 32 has nozzle communication openings 34 allowed to communicate with the nozzle orifices 19. The port formation plate 33 has a drilled ink supply opening 35 for establishing the communication between the common ink reservoir 24 and the first ink passage 29; and a through hole 36 for establishing the communication between the nozzle communication opening 34 and the second ink passage 30.

Therefore, the recording head 4 has a sequential ink passage formed from the common ink reservoirs 24 to the nozzle orifices 19 through the pressure chamber 22, the ink passage being provided for each of the nozzle orifices 19.

The piezoelectric vibrator 21 is joined to the rear surface of the vibration plate 27. The piezoelectric vibrator 21 incorporates a plate-like piezoelectric member 37; a lower electrode 38 (note that the lower electrode 38 is omitted in FIG. 2) formed disposed on the front surface of the piezoelectric member 37; and an upper electrode 39 disposed on the rear surface of the piezoelectric member 37. The printer 1 is deformed according to the difference in the potential between the upper electrode 39 and the lower electrode 38.

A terminal 40 electrically connected to the upper electrode 39 of the piezoelectric vibrator 21 is formed on the rear surface of the actuator unit 23. A film-like flexible circuit board 41 (a tape carrier package) is extended from the terminal 40. A drive signal generated by a drive signal generator 42 (see FIG. 5) is supplied to the upper electrode 39 of the piezoelectric vibrator 21 through the flexible circuit board 41 and the terminal 40.

The upper electrode 39 is formed to one-to-one correspond to each of the pressure chambers 22. The lower electrode 38 serves as a common electrode adjusted to a common potential (for example, the ground potential). Therefore, when a drive signal has been supplied to the upper electrode 39, a difference in the potential is imparted between the upper electrode 39 and the lower electrode 38. Thus, the piezoelectric vibrator 21 is deformed.

The recording head 4 has three actuator unit 23 mounted thereon. Two arrays of the pressure chambers 22 are provided for each actuator unit 23. Therefore, the recording head 4 has six arrays of pressure chambers 22. Arrays of nozzle orifices 19 are formed to correspond to the arrays of the pressure chambers 22. Thus, ink is ejected from the six nozzle arrays (that is, liquid droplets are jetted).

Each of the common ink reservoirs 24 in each of which ink to be supplied to the pressure chamber 22 is accumulated are formed into an elongated hole which corresponds of each of the arrays of the pressure chambers 22. In this embodiment, three arrays of common ink reservoirs 24 at the left-hand position in FIG. 2 are allowed to communicate with one another at their lengthwise ends. The foregoing common ink reservoirs 24 serves as common ink reservoirs **24*bk* for black ink. The other three common ink reservoirs 24 except for the foregoing common ink reservoirs 24*bk* serve as a yellow common-ink chamber 24*y*, a magenta common-ink chamber 24*m* and a cyan common-ink chamber 24*cy***, respectively.

Therefore, the three arrays of the six nozzle arrays from an end are black nozzle arrays for discharging black ink. Then, a yellow ink array for discharging yellow ink, a magenta ink array for discharging magenta ink and cyan ink array for discharging cyan ink are sequentially formed. Referring to FIG. 2, reference numeral 43 represents one of ink supply openings for supplying ink from the ink cartridges 2 to the common ink reservoirs 24.

Figure 4:
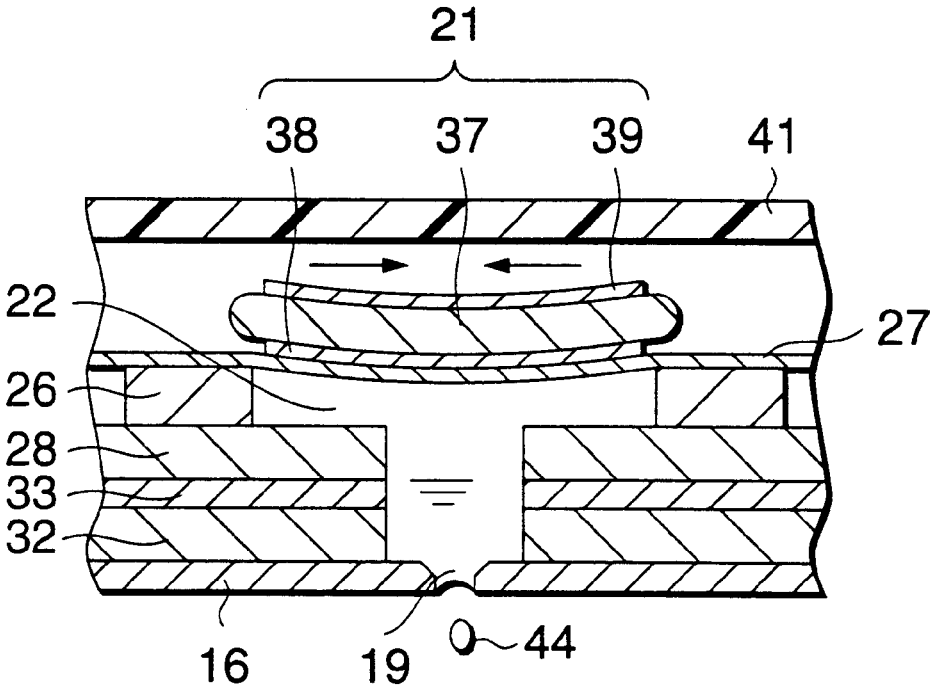
FIG. 4 is a cross sectional view showing the recording head in a state where a piezoelectric vibrator is deflected.

When a drive signal has been supplied to the piezoelectric vibrator 21 of the recording head 4 having the above-mentioned structure, the piezoelectric vibrator 21 is contracted laterally, as shown in FIG. 4. At this time, a portion of the piezoelectric vibrator 21 adjacent to the upper electrode 39 is contracted greatly as compared with a portion of the piezoelectric vibrator 21 adjacent to the vibration plate 27. Therefore, the piezoelectric vibrator 21 and the vibration plate 27 are deflected toward the pressure chamber 22 so that the pressure chamber 22 is contracted.

When the pressure chamber 22 has been contracted, the pressure of ink in the pressure chamber 22 is raised. Since the pressure of ink has been raised, ink in the pressure chamber 22 is ejected from the nozzle orifice 19 as an ink droplet 44. When the ejected ink droplet 44 reaches the recording paper 13, a dot is formed on the recording paper 13. When the piezoelectric vibrator 21 has been ejected and the original state has been restored, the inside portion of the pressure chamber 22 is expanded. Thus, the pressure in the pressure chamber 22 is reduced so that ink is supplied to the pressure chamber 22 from the common ink reservoirs 24 through the ink supply openings 35. Note that the recording head 4 will be described later.

Then, the electrical structure of the printer 1 will now be described. As show in FIG. 5, the printer 1 is provided with a printer controller 51 and a print engine 52.

The printer controller 51 incorporates an interface 53 for receiving print data and so forth from a host computer (not shown) and the forth; a RAM 54 in which various data items are stored; a ROM 55 in which a control routine for performing a variety of data processes and the like are stored; a control unit 12 comprising a CPU; an oscillator 56; a drive signal generator 42 for generating a drive signal to be supplied to the recording head 4; and an interface 57 for transmitting print data developed into dot pattern data (bit map data), a drive signal and so forth to the print engine 52.

The printer controller 51 further incorporates a card slot 67 for detachably holding a memory card 66 to serve as a recording medium holder; and a card interface 68 for transmitting information recorded in the memory card to the control unit 12. The card-like memory card 66 is one kind of a recording medium of the present invention, in which information such as a program is recordable. In this embodiment, a program for controlling the ink ejection of the recording head 4 is recorded in the memory card 66. The recording medium of the present invention is not limited to the above memory card 66 and if only it is detachable with respect to the recording medium holder, any other kinds of recording medium can be used such as a floppy disk, a hard disk, photomagnetic disk or the like.

In the above configuration, the control unit 12 controls the ink ejection with reference to the program recorded in the memory card 66 or a control routine recorded in the ROM 55 to serve as one embodiment of a computer of the present invention.

As a matter of course, the computer which executes various operations is not limited to the control unit 12. For example, it may be configured a single conventional host computer directly connected to the printer 1, or one of plural computers connected with each other by way of a network.

The interface 53 receives print data composed of either data of data items of a character code, a graphic function or image data or a plurality of data items of the same from the host computer. The interface 53 is able to output a busy (BUSY) signal and an acknowledge (ACK) signal to the host computer.

The RAM 54 serves as a reception buffer, an intermediate buffer, an output buffer and a working memory (not shown). In the reception buffer, print data supplied from the host computer is temporarily stored, intermediate code data is stored in the intermediate buffer and the dot pattern data is developed in the output buffer.

The ROM 55 has a variety of control routines which are performed by the control unit 12, font data, graphic functions and so forth stored therein.

A control routine (control program) which is permanently used without rewriting is recorded in the ROM 55, and a program which is to be rewritten for version up or the like is recorded in the memory card 66.

The control unit 12 serves as a print controller 58 (see FIG. 7) to produce bit map data. That is, the control unit 12 reads print data in the reception buffer so as to convert print data into intermediate code data. Then, the control unit 12 stores converted intermediate code data into the intermediate buffer. Moreover, the control unit 12 makes references to font data, the graphic function and so forth in the ROM 55 to develop intermediate code data read from the intermediate buffer into print data composed of dot pattern data. Print data, which has been developed as described above, is subjected to required decoration processes, and then stored in the output buffer. The control unit 12 as well as serves as a carriage controller 59 (see FIG. 7) to control the stepping motor 8.

The control unit 12 as well as serves as a head driver 60 (see FIG. 7) to discharge the ink droplets 44 from nozzle arrays Nk1 to Ncy of the recording head 4. That is, when print data corresponding to one line for the recording head 4 has been obtained, the control unit 12 serial-transmits print data for one line to the recording head 4 through the interface 57. Moreover, the control unit 12 outputs a latch signal to the recording head 4. The recording head 4 latches the transmitted print data at the timing of the latch signal to discharge the ink droplet 44 (to be described later).

When print data for one line has been output from the output buffer, the contents of the intermediate buffer are erased. Thus, the control unit 12 converts next intermediate code data.

The print engine 52 incorporates the stepping motor 8, the paper-feeding motor 14 and an electric operating system 61 for the recording head 4. The electric operating system 61 of the recording head 4 incorporates a shift register 62, a latch circuit 63, a level shifter 64, a switch 65 and a piezoelectric vibrator 21.

Figure 6:
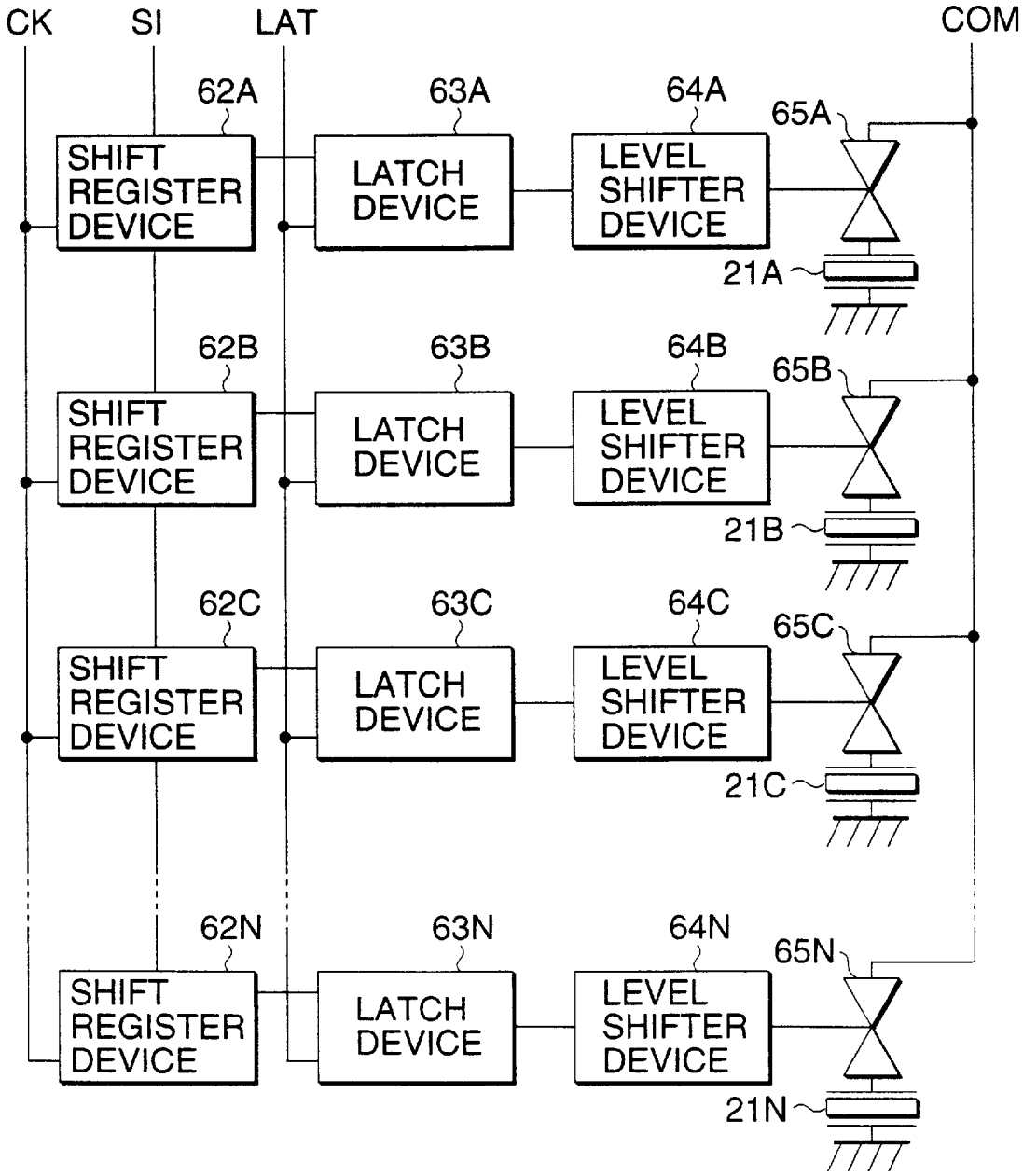
FIG. 6 is a block diagram showing an electric operation system for the recording head.

As shown in FIG. 6, the shift register 62, the latch circuit 63, the level shifter 64, the switch 65 and the piezoelectric vibrator 21 are constituted by shift register devices 62A to 62N, latch devices 63A to 63N, level shifter devices 64A of 64N, switch devices 65A to 65N and piezoelectric vibrators 21A to 21N to correspond to the nozzle orifices 19.

Print data (SI) is serial-transmitted to the shift register 62 through the interface 57 in response to a clock signal (CK) transmitted from the oscillator 56. Print data, which has been serial-transmitted, is latched by the latch circuit 63 at the timing of the latch signal (LAT). The level of latched print data is raised to a voltage level with which the switch 65 can be operated by the level shifter 64 which is a voltage amplifier. Print data having the raised level is supplied to the switch 65. A drive signal supplied from the drive signal generator 42 has been input to the input terminal of the switch 65, while the piezoelectric vibrator 21 is connected to the output terminal of the switch 65.

Print data controls the operation of the switch 65. For example, in a period in which print data which is supplied to the switch 65 is "1", the switch 65 is brought to a state of connection. Thus, a drive signal generated by the drive signal generator 42 is supplied to the piezoelectric vibrator 21. In response to the drive signal, the piezoelectric vibrator 21 is deformed. On the other hand, in a period in which print data which is supplied to the switch 65 is "0", the switch 65 is brought to a state of disconnection. As a result, the supply of the drive signal to the piezoelectric vibrator 21 is interrupted. As described above, deformation of the piezoelectric vibrator 21 causes the ink droplet 44 to be ejected from the nozzle orifices 19.

Figure 7:
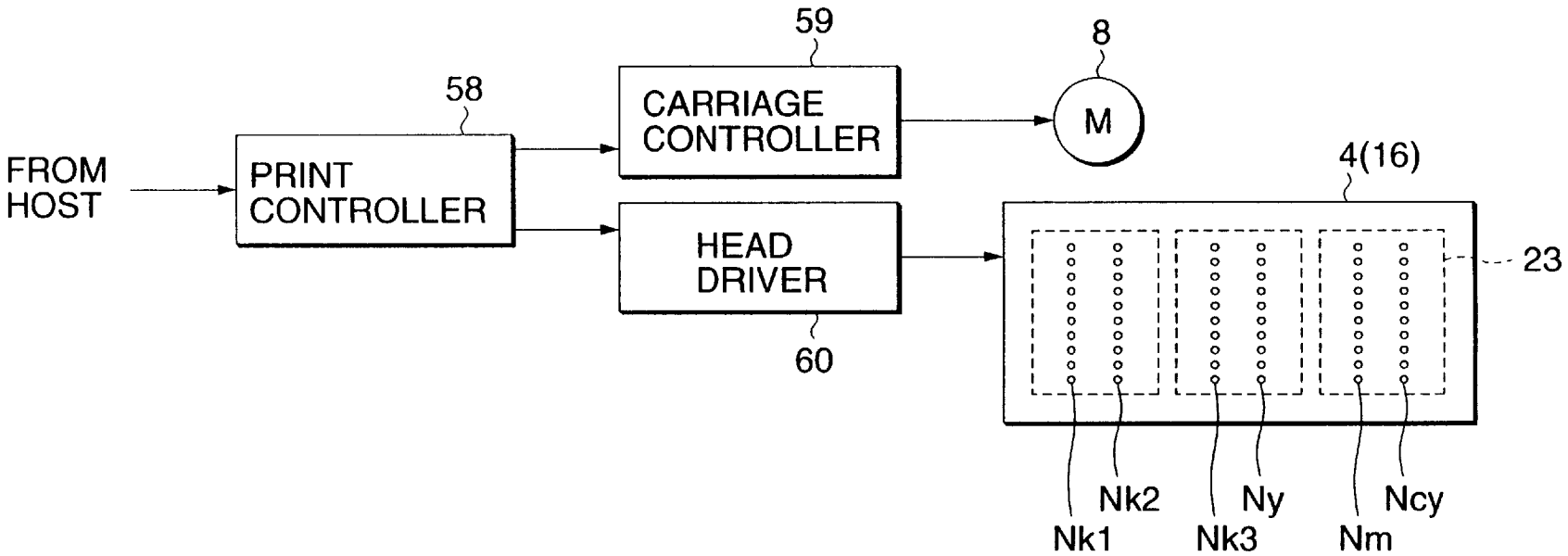
FIG. 7 is a block diagram showing the detailed structure of the recording head according to a first embodiment of the invention.

The recording head 4 will now be described. FIG. 7 shows the recording head 4 in detail.

As described above, the recording head 4 incorporates three actuator units 23. Each of the actuator units 23 incorporate two nozzle arrays, that is, six nozzle arrays are provided. When the nozzle arrays are viewed from a left-hand end in FIG. 7, there are sequentially arranged a first black nozzle array Nk1, a second black nozzle array Nk2, a third black nozzle array Nk3, a yellow nozzle array Ny, a magenta nozzle array Nm and a cyan nozzle array Ncy.

The first black nozzle array Nk1 and the second black nozzle array Nk2 constitute a first nozzle group, while the third black nozzle array Nk3 constitutes a second nozzle group. The three nozzle arrays consisting of the yellow nozzle array Ny, the magenta nozzle array Nm, the cyan nozzle array Ncy form a third nozzle group.

The types of ink to be ejected are determined to each of the first, second and third nozzle groups. In this embodiment, both of the first and second nozzle groups discharge black ink (corresponding to the first ink). The third nozzle group discharges color ink (corresponding to ink of a type different from first ink).

In this embodiment, the third black nozzle array Nk3 constituting the second nozzle group and the yellow nozzle array Ny included in the third nozzle group are disposed adjacent to each other in the main scanning direction.

Ink for use in the recording head 4 will now be described. In this embodiment, two types of ink solutions are used which degrees of permeation into the recording paper 13 which are different from each other. That is, black ink is slow permeable ink (low permeable ink) which relatively slowly permeates into the recording paper 13 so as to be fixed to the recording paper 13 while being dried. Since low permeable ink is able to record a sharp edge, characters and the like can satisfactorily be recorded. On the other hand, color ink, such as yellow ink, magenta ink and cyan ink, is high permeable ink (that is, ink showing high permeation as compared with low permeable ink) which shows high permeation into the recording paper 13. High permeable ink has a characteristic that quick permeation into the recording paper 13 is permitted. Therefore, color mixture with ink in the other colors cannot easily occur. Therefore, high permeable ink is suitable for recording a photograph or an image.

When high permeable ink is used as color ink and low permeable ink is used as black ink, the quality of an image and a document can be improved.

The composition of ink will now be described. Ink may be aqueous solution or organic solution. It is preferable that ink is aqueous solution. The viscosity of ink is 1 cps to 10 cps. Ink may contain an arbitrary coloring matter. That is, dye may be direct dye, acid dye, food dye, basic dye or reactive dye. Pigment may be inorganic pigment and/or organic pigment.

Dye may be any one of black dye, yellow dye, magenta dye and cyan dye.

Black dye is exemplified by C. I. Direct Black 17, C. I. Direct Black 19, C. I. Direct Black 62, C. I. Direct Black 154, C. I. Food Black 2, C. I. Reactive Black 5, C. I. Acid Black 52 and C. I. Project Fast Black 2.

Yellow dye is exemplified by C. I. Direct Yellow 11, C. I. Direct Yellow 44, C. I. Direct Yellow 86, C. I. Direct Yellow 142, C. I. Direct Yellow 330, C. I. Acid Yellow 3, C. I. Acid Yellow 38, C. I. Basic Yellow 11, C. I. Basic Yellow 51, C. I. Disperse Yellow 3, C. I. Disperse Yellow 5 and C. I. Reactive Yellow 2.

Magenta dye is exemplified by C. I. Direct Red 227, C. I. Direct Red 23, C. I. Acid Red 18, C. I. Acid Red 52, C. I. Basic Red 14, C. I. Basic Red 39 and C. I. Disperse Red 60.

Cyan dye is exemplified by C. I. Direct Blue 15, C.I. Direct Blue 199, C. I. Direct Blue 168, C. I. Acid Blue 9, C. I. Direct Blue 40, C. I. Basic Blue 41, C. I. Acid Blue 74 and C. I. Reactive Blue 15.

Organic pigment is exemplified by titanium oxide, iron oxide and carbon black manufactured by a known method, such as a contact method, a furnace method or a thermal method. Organic pigment is exemplified by azo pigment (including azo lake, insoluble azo pigment, condensation azo pigment and chelate azo pigment), polycyclic pigment (for example, phthalocyanine pigment, perylene pigment, perinone pigment, anthraquinone pigment, quinacridone pigment, dioxazine pigment, thioindigo pigment, isoindrinone pigment or quinophthalone pigment), dye chelate (for example, basic dye-family chelate or acidic dye-family chelate), nitropigment, nitrosopigment or aniline black may be employed.

Specifically, yellow pigment may be C. I. Pigment Yellow 74, 109, 110 or 138. Magenta pigment may be C. I. Pigment Red 122, 202 or 209. Cyan pigment may be C. I. Pigment Blue 15:3 or 60. Black pigment may be C. I. Pigment Black 7. Orange pigment may be C. I. Pigment Orange 36 or 43. Green pigment may be C. I. Pigment Green 7 or 36. Also white pigment (that is, white ink) may be employed.

It is preferable that the concentration of the foregoing coloring matter in ink 0.1 wt % to 10 wt %. It is preferable that the progressive average particle size of pigment is 20 nm to 250 nm, more preferably 50 nm to 200 nm.

Pigment Ink will now be described. Note that the following description may be applied to dye ink except for the description about a dispersant.

A preferred dispersant may be a known dispersant for use to prepare known pigment solution, for example, a polymer dispersant or a surface active agent. The polymer dispersant is exemplified by a natural polymer compound, such as a protein material, for example, glue, gelatin, cazein or albumin; natural rubber, such as gum arabic or tragacanth gum; glucoside, such as saponin; alginic acid derivative, such as alginic acid, propylene glycol alginate, triethanol amine alginate or ammonium alginate; and cellulose derivative, such as methyl cellulose, carboxylic methyl cellulose, hydroxyethyl cellulose or ethylhydroxyethyl cellulose.

As the polymer dispersant, a synthetic polymer compound may be employed. The polymer compound is exemplified by polyvinyl alcohol; polyvinyl pyrolidone; acrylic resin, such as polyacrylic acid, an acrylic acid-acrylonitrile copolymer, a potassium acrylate-acrylonitrile copolymer, a vinylacetate-acrylate copolymer or an acrylic acid-alkylacrylate copolymer; styrene-acrylate copolymer, such as a styrene-acrylate copolymer, a styrene-methacrylate copolymer, a styrene-alkylacrylate methacrylate copolymer, a styrene-$\alpha$-methylstyrene-acrylate copolymer or a styrene-$\alpha$-methylstyrene-acrylate-alkylacrylate copolymer; styrene-maleic acid; styrene-maleic anhydride; a vinyl acetate copolymer, such as a vinyl acetate-ethylene copolymer, a vinyl acetate-fatty acid vinylethylene copolymer, a vinyl acetate-maleate copolymer, a vinyl acetate-crotonate copolymer or a vinyl acetate-acrylate copolymer; or their salts.

In particular, it is preferable that a copolymer of a monomer having a hydrophobic group and a monomer having a hydrophilic group or a polymer composed of monomers each having the hydrophobic group and the hydrophilic group is employed.

The salt is exemplified by diethyl amine, ammonia, ethylamine, triethylamine, propyl amine, isopropylamine, dipropylamine, butylamine, isobutylamine, triethanol amine, diethanol amine, aminomethyl propanol or morpholine. It is preferable that the weight average molecular weight is 3,000 to 30,000, more preferably 5,000 to 15,000.

A preferred surface active agent serving as the dispersant is exemplified by an anionic surface active agent, such as fatty acid salt, higher alkyldicarboxylate, higher alcohol sulfate, higher alkyl sulfonate, a condensation material of higher fatty acid and amino-acid, sulfosuccinate, naphthenate, sulphate of liquid fatty oil or alkylallyl sulfonate; a cation surface active agent, such as fatty acid amine salt, quaternary ammonium salt, sulfonium salt or phosphonium; and a nonion surface active agent, such as polyoxyethylene alkyl ether, polyoxyethylene alkyl ester, sorbitan alkyl ester or polyoxyethylene sorbitan alkyl ester.

It is preferable that the quantity of the dispersant to be added is 0.06 wt % to 3 wt % with respect to 1 wt % of pigment, more preferably 0.125 wt % to 3 wt %.

It is preferable that the surface tension of ink which is an index of the permeation is 10 mN/m to 80 mN/m, more preferably 28 mN/m to 50 mN/m. Black ink according to this embodiment varies according to the type of the recording paper 13 or the like. Black ink having a surface tension of about 50 mN/m to about 80 mN/m. Yellow ink, magenta ink and cyan ink vary according to the type of the recording paper 13 or the like. Ink having a surface tension of about 10 mN/m to about 30 mN/m is employed.

It is preferable that ink contains lubricant. A preferred lubricant is exemplified by diethylene glycol, polyethylene glycol, polypropylene glycol, ethylene glycol, propylene glycol, butylene glycol, triethylene glycol, 1, 2, 6-hexanetriol, thioglycol, hexylene glycol, glycerine, trimethylol ethane, trimethylol propane, urea, 2-pyrolidone, N-methyl-2-pyrolidone and 1, 3-dimethyl-2-imidazolidine. In particular, it is preferable that lubricant containing an ethylene oxide is employed. It is preferable that diethylene glycol is employed. It is further preferable that low-boiling-point organic solvent is added as well as the lubricant.

The low-boiling-point organic solvent is exemplified by methanol, ethanol, n-propanol, iso-propanol, n-butanol, sec-butanol, tert-butanol, iso-butanol, n-pentanol, ethylene glycol, monomethylether, ethylene glycol monoethylether, diethylene glycol monomethyl ether, diethylene glycol monoethylether, triethylene glycol monomethylether and triethylene glycol monoethylether. In particular, it is preferable that monohydric alcohol is employed.

It is preferable that the quantity of the lubricant to be added is 0.5 wt % to 40 wt %, more preferably 2 wt % to 20 wt %. It is preferable that the quantity of the low-boiling-point organic solvent to be added is 0.5 wt % to 10 wt % of ink, more preferably 1.5 wt % to 6 wt %.

Ink may contain a surface active agent. A preferred surface active agent is exemplified by an anion surface active agent (for example, sodium dodecylbenzel sulfonate, sodium laulate or ammonium salt of polyoxyethylene alkyl ether sulfate) and a nonion surface active agent (for example, polyoxyethylene alkylether, polyoxyethylene alkyl ester, polyoxyethylene sorbitane fatty acid ester, polyoxyethylene alkylphenylether or polyoxyethylene alkylamine or polyoxyethylene alkylamide). The foregoing surface active agent may be employed solely or two or more types of the surface active agents may be employed. An acetylene glycol (olefin Y, Sufinol 82, 104, 440, 465, 485 or TG (manufactured by Air Produce & Chemical Inc.) surface active agent may be employed.

Moreover, a pH adjustment material, an antiseptic agent and/or a mildewproofing agent may be added to ink.

Ink can be manufactured by dispersing and mixing the foregoing components by proper methods. When pigment ink is employed, it is preferable that a mixture obtained by removing organic sensitivity and volatile components is mixed by a proper dispersing machine (for example, a ball mill, a sand mill, an atrittor, a roll mill, an agitator mill, a Henschel mixer, a colloid mill, an ultrasonic homogenizer, a jet mill or an angmill) so as to be formed into a uniform composition. Then, the organic sensitivity and the volatile components are added. Then, coarse particles and foreign matter which cause clogging are removed by filtration (reduced-pressure or pressure-applied filtration using a metal filter or a membrane filter) or centrifugation.

Low permeation black ink and high permeation color ink are different from each other in a proper quantity of the ink droplet 44. That is, when a monochrome recording operation is performed by using low permeation black ink, the ink droplet 44 in a relatively large quantity must be ejected to form a complete solid portion without reduction in the recording speed. High permeation color ink has high permeation into the recording paper 13 and the diameter of a dot suitable for the color recording operation is sufficiently small as compared with the size of a dot suitable for the monochrome recording operation. Therefore, the ink droplet 44 in a very small quantity permits a dot having a size suitable for the color recording operation to be formed.

It might be feasible to employ black ink when a color recording operation is performed. If the diameter of a black dot in the color recording operation is the same as that in the monochrome recording operation, only the black dots are undesirably enlarged as compared with the color dots. Thus, there is apprehension that the image quality deteriorates. Therefore, when the color recording operation is performed, the size of each black dot must be the same as the size of each color dot.

The recording head 4 incorporates the three nozzle arrays Nk1 to Nk3 arranged to discharge black ink (first ink) and constituted by two types of nozzle arrays each of which discharges the ink droplets 44 in different quantities. That is, the first black nozzle array Nk1 and the second black nozzle array Nk2 constituting the first nozzle group are nozzle arrays for discharging large ink droplets 44, the quantity of each of which is relatively large. On the other hand, the third black nozzle array Nk3 constituting the second nozzle group is a nozzle array for discharging a small ink droplet 44, the quantity of which is relatively small.

The yellow nozzle array Ny, the magenta nozzle array Nm and the cyan nozzle array Ncy for discharging color ink, that is, the third nozzle group is constituted by nozzle arrays for discharging small ink droplets 44, the quantity of which is substantially the same as that of the third black nozzle array Nk3. That is, the quantity of each ink droplet 44 which is ejected from the second nozzle group and the quantity of each ink droplet 44 which is ejected from the third nozzle group are made to be the same.

Figure 8:
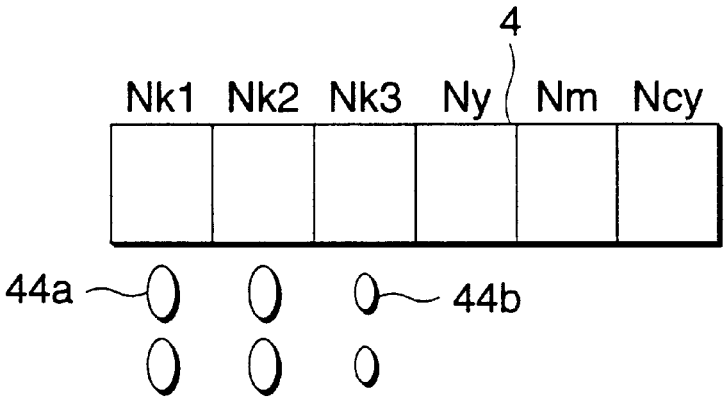
FIGS. 8 and 9 are diagrams showing the operation of the recording head of FIG. 7.
Figure 9:
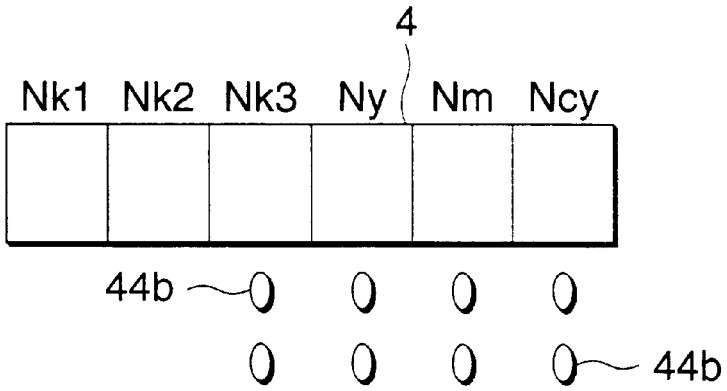

When a monochrome recording operation is performed with which only black ink is used, a large ink droplet 44*a* with which is capable of forming a large dot is ejected from each of the first black nozzle array Nk1 and the second black nozzle array Nk2, as shown in FIG. 8. The third black nozzle array Nk3 discharges a small ink droplet 44*b* which is capable of forming a small dot.

When a color recording operation is performed with which black ink and color ink are used, the small ink droplet 44*b* is ejected from the third black nozzle array Nk3. Each of the yellow nozzle array Ny, the magenta nozzle array Nm and the cyan nozzle array Ncy discharges the small ink droplet 44*b*.

The large ink droplet 44*a* is arranged to have a volume of about 60 picoliter to 100 picoliter in spite of the value being varied according to the permeability of ink, the type of the recording paper 13 or the recording mode. On the other hand, the small ink droplet 44*b* is arranged to have a volume of about 3 picoliter to 20 picoliter in spite of the value being varied according to the permeability of ink, the type of the recording paper 13 or the recording mode.

The ink droplets 44 in different quantities are ejected from the nozzle arrays by a method with which the area of opening of each pressure chamber 22 is varied among the nozzle arrays. The method is not limited to the foregoing method. A variety of methods may be employed, for example, a method of varying the diameters of the nozzle orifices 19 among the nozzle arrays.

The operation of the recording head 4 will now be described. The recording head 4 is operated, for example, as follows so that a recording operation is performed. Initially, ink cartridges 2*a* and 2*b* having low permeation black ink and high permeation color ink (that is, yellow ink, magenta ink and cyan ink) having different permeation properties into the recording paper 13 therein are mounted on the cartridge holder 3 of the carriage 5.

When monochrome characters or the like are recorded, the large ink droplets 44*a* are ejected from the first black nozzle array Nk1 and the second black nozzle array Nk2. Moreover, also the third black nozzle array Nk3 discharges the small ink droplet 44*b*.

When a color photograph or a color image is recorded, the third black nozzle array Nk3 discharges the small ink droplet 44*b*. The yellow nozzle array Ny, the magenta nozzle array Nm and the cyan nozzle array Ncy discharge corresponding small ink droplets 44*b* in yellow, magenta and cyan.

In this operation, the control unit 12 serves as a first ejection controller of the present invention for ejecting liquids from the first black nozzle array Nk1, the second black nozzle array Nk2 and the third black nozzle array Nk3 in accordance with the control program recored in the memory card 66. Here, the amount of liquid ejected from the first black nozzle array Nk1 and the second black nozzle array Nk2 (the first nozzle group) is so set as to be greater than the amount of liquid ejected from the third black nozzle array Nk3 (the second nozzle group).

It may be configured that an element other than the control unit 12 can be controlled based on the control program stored in the memory card 66. Namely, the first ejection controller can be constituted by the element other than the control unit 12. For example, operations of a single host computer connected to the printer 1 or one of plural computers connected with each other by way of a network may be controlled by the control program stored in the memory card 66.

As described above, the recording head 4 and the operation method therefor permit a recording operation to be performed such that the single recording head 4 uses plural types of ink having the different degree of permeation with respect to the recording paper 13.

When the monochrome recording operation is performed by using only black ink, the first black nozzle array Nk1 and the second black nozzle array Nk2 discharge large ink droplets 44*a*. The third black nozzle array Nk3 discharges the small ink droplet 44*b*. Therefore, the recording operation can be performed without deterioration in the linear speed and the resolution.

When a color recording operation is performed by using low permeation black ink and high permeation color ink, the third black nozzle array Nk3 discharges the small ink droplet 44*b* in black. The yellow nozzle array Ny discharges the small ink droplet 44*b* in yellow. The magenta nozzle array Nm discharges the small ink droplet 44*b* in magenta. The cyan nozzle array Ncy discharges the small ink droplet 44*b* in cyan. Therefore, a recording operation can be performed with high resolution.

In this operation, the control unit 12 serves as a second ejection controller of the present invention which ejects inkdrops from the first black nozzle array Nk1, the second black nozzle array Nk2 and the third black nozzle array Nk3 when only the black ink (a first kind of liquid) is ejected to conduct a monochrome printing; and ejects inkdrops from the third black nozzle array Nk3 and the color nozzle arrays Ny, Nm, Ncy (the third nozzle group) when the black ink and the color ink (a second kind of liquid) in accordance with the control program recorded in the memory card 66.

It may be configured that the second ejection controller can be constituted by an element other than the control unit 12. For example, operations of a single host computer connected to the printer 1 or one of plural computers connected with each other by way of a network may be controlled by the control program stored in the memory card 66.

As a result, the sizes of the recording head 4 and the printer 1 can be reduced and the structures of the same can be simplified. Hence it follows that manufacture can easily be completed and the number of elements can be reduced. It leads to a fact that the recording head 4 and the printer 1 can be manufactured with low costs.

When a color image is recorded such that the quantities of the ink droplets 44 of color ink and black ink are the same, the sizes of dots formed on the recording paper 13 are somewhat different from each other. That is, the size of each black dots is undesirably smaller than the size of each color dot. The reason for this lies in that color ink is high permeable ink and black ink is low permeable ink.

In the foregoing case, a recording operation using black dots is performed at resolution higher than the resolution employed when a recording operation using color dots is performed so that the difference in the dot size can be eliminated. For example, an area which can be recorded by one color dot is recorded by two black dots. When the structure is formed as described above, the image quality furthermore be improved.

Figure 10:
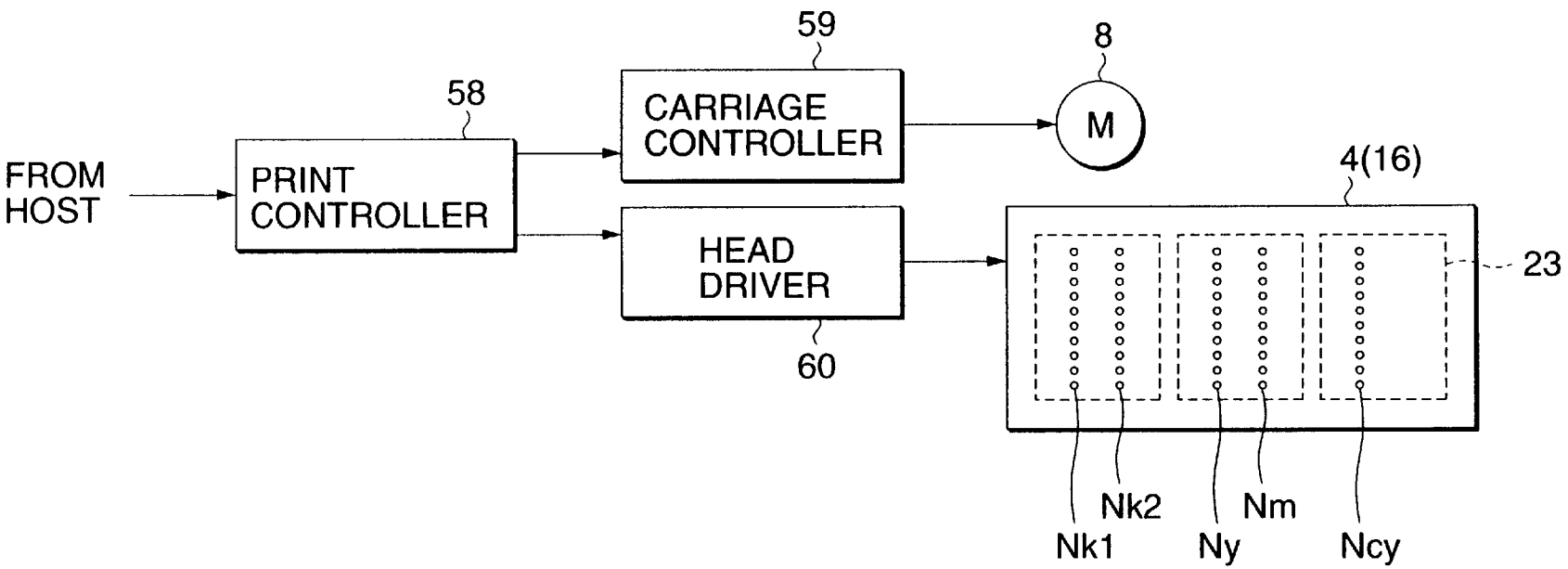
FIG. 10 is a diagram showing the detailed structure of a recording head according to a second embodiment of the invention.

A second embodiment of the present invention will now be described. As shown in FIG. 10, the second embodiment has a structure that the recording head 4 incorporates two black nozzle arrays for discharging black ink. A first black nozzle array Nk1 constitutes a first nozzle group and a second black nozzle array Nk2 constitutes a second nozzle group. The first black nozzle array Nk1 discharges a large ink droplet 44, while the second black nozzle array Nk2 discharges a small ink droplet 44.

The other structures are similar to those according to the first embodiment. Similar elements are given the same reference numerals.

Figure 11:
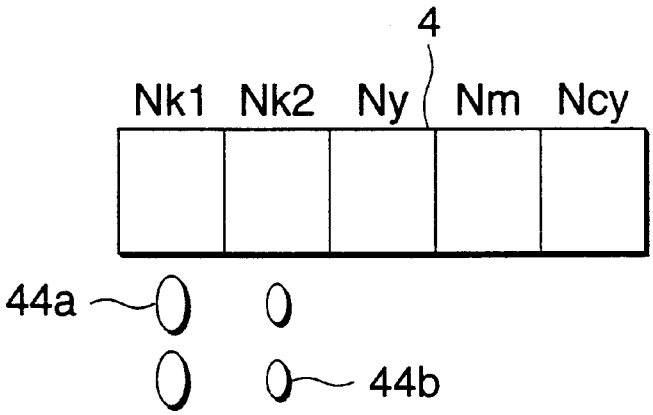
FIGS. 11 and 12 are diagrams showing the operation of the recording head of FIG. 10.

When monochrome characters or the like are recorded by the recording head 4, the first black nozzle array Nk1 discharges the large ink droplet 44*a* and the second black nozzle array Nk2 discharges the small ink droplet 44*b*, as shown in FIG. 11.

Figure 12:
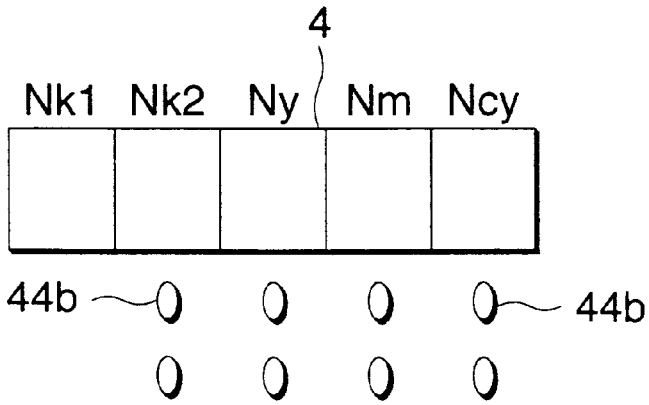

When a photograph or an image is color-recorded, the second black nozzle array Nk2 discharges the small ink droplet 44*b* of black ink, as shown in FIG. 12. The yellow nozzle array Ny discharges the small ink droplet 44*b* of yellow ink, the magenta nozzle array Nm discharges the small ink droplet 44*b* of magenta ink and the cyan nozzle array Ncy discharges the small ink droplet 44*b* of cyan ink. Also the foregoing recording head 4 attains a similar operation and effects to those obtainable from the first embodiment.

Each of the foregoing embodiments is structured such that the type of ink is assigned to each nozzle group so as to be ejected. The present invention is not limited to the foregoing structure. For example, a structure may be employed in which the nozzle array is divided into a plurality of nozzle blocks. Moreover, the type of ink is assigned to each nozzle block. Another embodiment having the foregoing structure will now be described.

Figure 13A:
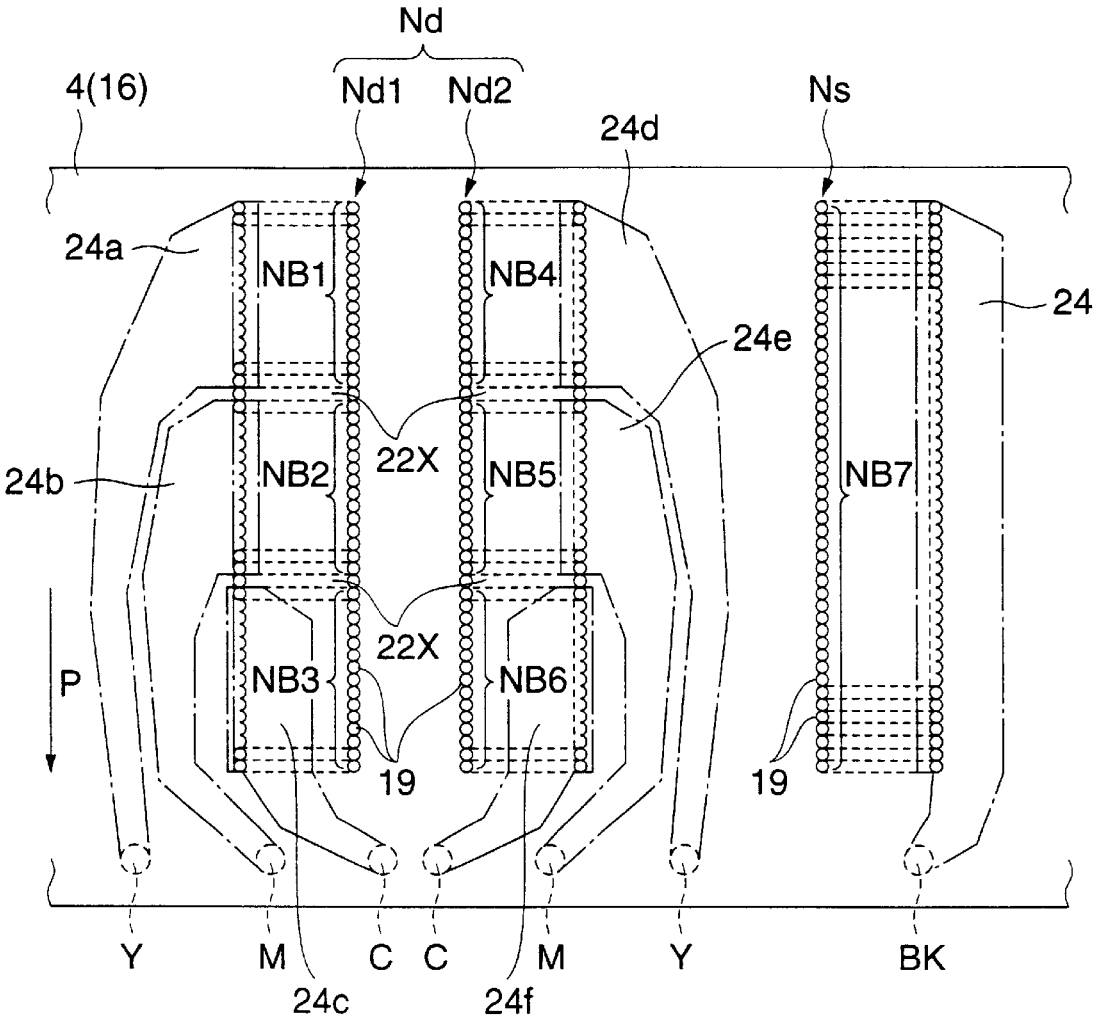
FIG. 13A is a diagram showing the structure of nozzle arrays of a recording head according to a third embodiment of the invention.

FIG. 13 is a diagram showing a recording head 4 according to a third embodiment when the recording head 4 is viewed from a position adjacent to the nozzle plate 16. The recording head 4 shown in FIG. 13A incorporates nozzle arrays formed by arranging a plurality of nozzle orifices 19 in the sub-scanning direction in a line. Three arrays are disposed in parallel with one another in the main scanning direction. Two arrays which is the central array and one side array are divided nozzle arrays Nd (a first divided nozzle array Nd1 and a second divided nozzle array Nd2) each of which is divided into three nozzle blocks in the sub-scanning direction. The residual one nozzle array is a unit color nozzle array Ns which is not divided. The divided nozzle arrays Nd discharge ink in different colors.

That is, the first divided nozzle array Nd1 is equally divided into a first nozzle block NB1 disposed most upstream position in the paper feeding direction, a second nozzle block NB2 disposed adjacent to and downstream of the first nozzle block NB1 and a third nozzle block NB3 disposed at the most downstream position. Similarly, the second divided nozzle array Nd2 is equally divided into a fourth nozzle block NB4 disposed most upstream in the paper feeding direction, a fifth nozzle block NB5 disposed adjacent to and downstream of the fourth nozzle block NB4 and a sixth nozzle block NB6 disposed most downstream.

The divided nozzle arrays Nd1 and Nd2 have dummy pressure chambers 22X between nozzle blocks adjacent in the nozzle array direction, for example, between the first nozzle block NB1 and the second nozzle block NB2 and between the fifth nozzle block NB5 and the sixth nozzle block NB6. The dummy pressure chambers 22X are pressure chambers which do not concern discharge of ink droplets.

Since the dummy pressure chamber 22X is formed between the adjacent nozzle blocks, adjacent crosstalk (an influence of a pressure wave from another nozzle block) from another nozzle block adjacent in the direction of the nozzle arrays can be prevented. Note that the dummy pressure chamber 22X is provided as necessary.

The first nozzle block NB1 of the first divided nozzle array Nd1 is a yellow block for discharging yellow ink, the second nozzle block NB2 is a magenta block for discharging magenta ink and the third nozzle block NB3 is a cyan block for discharging cyan ink. Similarly, the fourth nozzle block NB4 of the second divided nozzle array Nd2 is a yellow block for discharging yellow ink, the fifth nozzle block NB5 is a magenta block for discharging magenta ink and the sixth nozzle block NB6 is a cyan block for discharging cyan ink. As described above, the divided nozzle arrays Nd1 and Nd2 discharge ink in three colors, which are yellow ink, magenta ink and cyan ink.

Therefore, each of the common ink reservoirs 24 corresponding to the divided nozzle arrays Nd is provided for each of the nozzle blocks (NB1 to NB6). Thus, corresponding color ink is supplied to each of the common ink reservoirs 24. That is, yellow ink accumulated in the color cartridge 2*b* is supplied to the first common ink reservoir 24*a* corresponding to the first nozzle block NB1. Magenta ink is supplied to the second common ink reservoir 24*b* corresponding to the second nozzle block NB2. Cyan ink is supplied to the third common ink reservoir 24*c* corresponding to the third nozzle block NB3. Yellow ink is supplied to the fourth common ink reservoir 24*d* corresponding to the fourth nozzle block NB4. Similarly, magenta ink is supplied to the fifth common ink reservoir 24*e* corresponding to the fifth nozzle block NB5, while cyan ink is supplied to the sixth common ink reservoir 24*f* corresponding to the sixth nozzle block NB6.

Figure 13B:
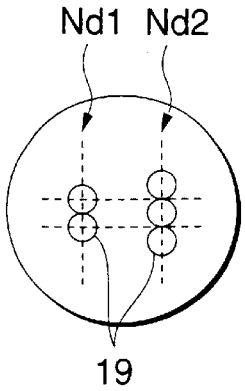
FIG. 13B is an enlarged diagram showing the positions of nozzle orifices between the nozzle arrays.

The divided nozzle arrays Nd1 and Nd2 are structured such that the nozzle orifices 19 are arranged to form a zigzag configuration between the divided nozzle arrays Nd, as shown in FIG. 13B. That is, the nozzle orifice 19 of the first divided nozzle array Nd1 and the nozzle orifice 19 of the second divided nozzle array Nd2 are formed at the same pitch in the sub-scanning direction. On the other hand, the nozzle orifice 19 constituting the first divided nozzle array Nd1 is formed between the nozzle orifices 19 for constituting the second divided nozzle array Nd2. That is, the position is shifted in the sub-scanning direction.

In addition, as described above, the nozzle arrays Nd1 and Nd2 constitute divided nozzle arrays. However, at least two of the nozzle arrays may not be divided into divided nozzle arrays. In such an implementation, the nozzle orifices in one of the "non-divided" nozzle arrays may be formed in a zigzag configuration with the nozzle orifices in another one of the "non-divided" nozzle arrays.

The nozzle blocks of the divided nozzle arrays Nd adjacent to each other in the main scanning direction discharge ink in the same color. That is, the first nozzle block NB1 and the fourth nozzle block NB4 discharge yellow ink, the second nozzle block NB2 and the fifth nozzle block NB5 discharge magenta ink and the third nozzle block NB3 and the sixth nozzle block NB6 discharge cyan ink. Thus, the resolution of each color in the sub-scanning direction can substantially be doubled. As a result, an image having furthermore improved image quality can be recorded.

The colors of ink arranged to be supplied from the first nozzle block NB1 to sixth nozzle block NB6 are not limited to the foregoing combination. The combination may arbitrarily be determined. For example, a structure may be employed in which the first nozzle block NB1 and the fourth nozzle block NB4 discharge cyan ink, the second nozzle block NB2 and fifth nozzle block NB5 discharge yellow ink and the third nozzle block NB3 and sixth nozzle block NB6 discharge magenta ink.

When the combination of colors of ink arranged to be ejected from the nozzle blocks is optimized, color interference among ink does not easily occur when a color image is recorded. As a result, an image having high quality can be recorded.

For example, as shown in FIG. 13A, each of the magenta blocks (the second nozzle block NB2 and the fifth nozzle block NB5) is disposed between each of the yellow blocks (the first nozzle block NB1 and the fifth nozzle block NB5) and each of the cyan blocks (the third nozzle block NB3 and the sixth nozzle block NB6). Thus, the interference of different colors can be prevented.

That is, if cyan ink is undesirably mixed before yellow ink permeates the recording paper 13 even in a small quantity, the yellow tone deteriorates. The recording head 4 is structured such that the magenta block is disposed between the yellow block and the cyan block so that the region recorded by the yellow block is subject to a recording operation which is performed by the magenta block and then subjected to a recording operation which is performed by the cyan block.

As a result, yellow ink sufficiently permeates the recording paper 13, and then a recording operation using cyan ink is performed. Thus, deterioration in the image quality caused from mixture of yellow ink and cyan ink can reliably be prevented.

The structure shown in FIG. 13A is arranged such that the yellow blocks are disposed at the upstream positions in the paper feeding direction. Moreover, the cyan blocks are disposed at the downstream portions in the paper feeding direction. The foregoing order may be inverted, that is, the cyan block, the magenta block and the yellow block may be disposed in the foregoing order starting with the upstream position in the paper feeding direction P.

In the foregoing case, a recording operation which is performed by the cyan block is first performed, and then a recording operation is performed by the magenta block, and then a recording operation is performed by the yellow block. That is, the recording operations are performed in the ascending order of the brightness. Thus, deterioration in the image quality caused from color mixture can furthermore reliably be prevented.

The unit color nozzle array Ns is constituted by a single nozzle block (the seventh nozzle block NB7) and formed into a black nozzle array for discharging black ink. Since the unit color nozzle array Ns is formed into the black nozzle array, time required to complete an operation for recording document data can be shortened.

As described above, time required to record document data can be shortened. Moreover, the image quality of data of a color image can be improved. Therefore, a requirement from a user can satisfactorily be met.

The relationship between the nozzle arrays and ink will now be described. In this embodiment, the divided nozzle arrays Nd discharge dye-family ink and the unit color nozzle array Ns discharges pigment-family ink. That is, color ink, which include yellow ink, magenta ink and cyan ink, is dye-family ink. The black ink is pigment-family ink.

As described above. dye-family ink is high permeable ink which is able to satisfactorily permeates the recording paper 13. Therefore, the ink droplet 44 moved to the surface of the recording paper 13 quickly permeates the recording paper 13. Therefore, overprinting of ink in different colors does not easily cause color mixture of ink. Thus, the foregoing structure is suitable for a color recording operation. On the other hand, pigment-family ink is a low permeable ink which slowly permeate the recording paper 13 as compared with dye-family ink. However, a sharp edge of a recorded dot can be formed. Therefore, pigment-family ink is suitable for recording a document.

Therefore, the arrangement that color ink is dye-family ink which is high permeable ink and black ink is pigment-family ink which is low permeable ink is able to improve the image quality of a recorded image and a document.

Note that the combination of ink is not limited to the foregoing description. The combination is arbitrarily determined to meet the purpose of the recording operation. For example, a structure may be employed in which the unit color nozzle array Ns discharges black ink which is dye-family ink and the divided nozzle arrays Nd discharge color ink which is pigment-family ink.

In this embodiment, a plurality of types of ink solutions having different degrees of permeation are ejected from the single recording head 4. Therefore, the recess in the capping member 18 is divided to correspond to the types of ink, for example, dye-family ink and pigment-family ink. The recording head 4 incorporates three recess arrays formed in the main scanning direction such that one recess corresponds to one nozzle array (Nd1, Nd2 or Ns1). When the foregoing structure is employed, the splashing range of ink is limited when the capping mechanism 17 is operated to forcibly suck ink from the recording head 4. Therefore, the problem of mixture of pigment-family ink and dye-family ink can be prevented.

Note that the structure of the recess in the capping member 18 is not limited to the foregoing structure. For example, the recess may be provided for each nozzle block (the first nozzle block NB1 to seventh nozzle block NB7).

Figure 14:
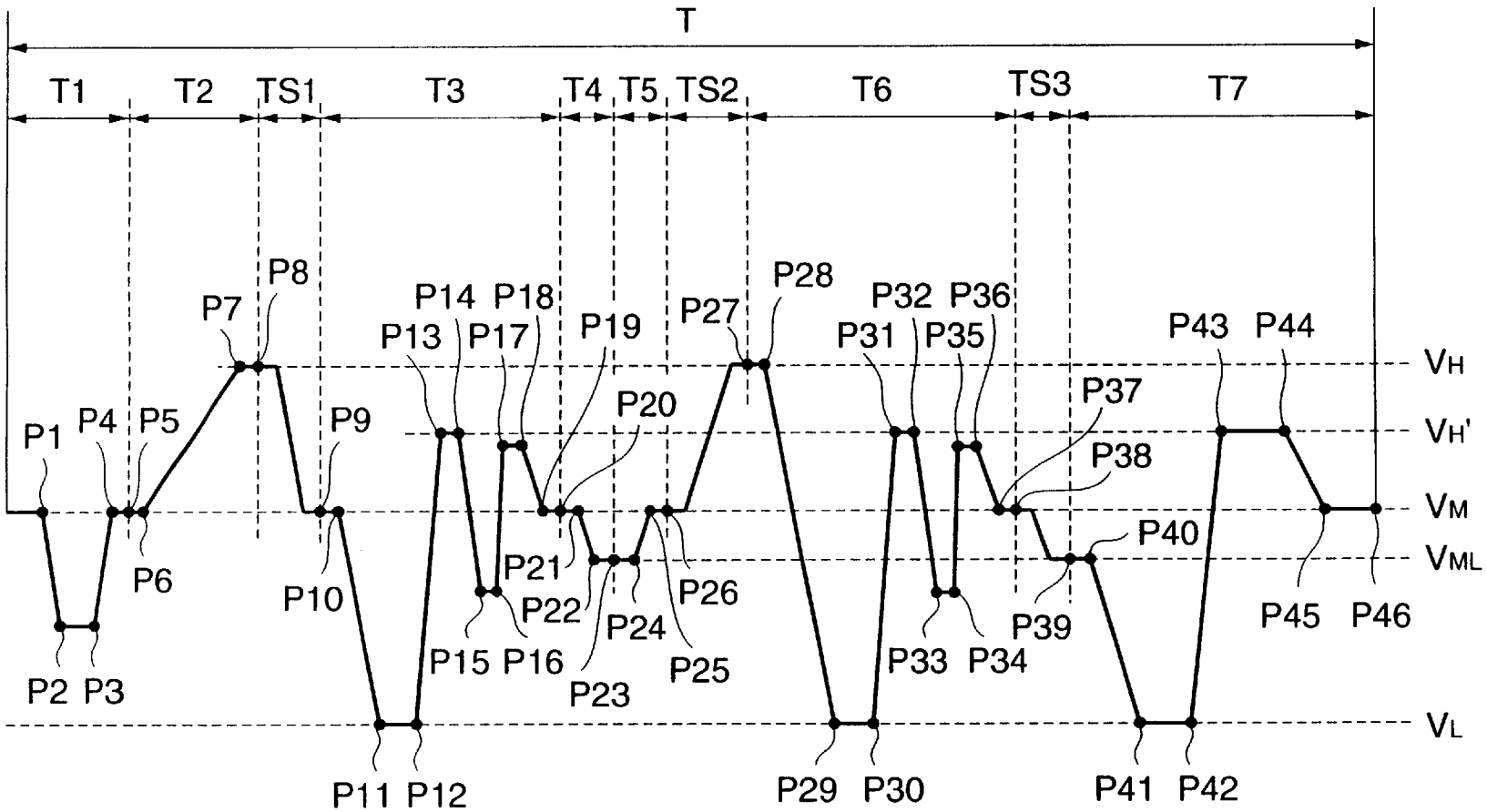
FIG. 14 is a diagram showing example of a drive signal.

A method of controlling the recording head 4 will now be described. A drive signal which is generated by the drive signal generator 42 will now be described. As shown in FIG. 14, the drive signal has a waveform element constituting a fine-vibration pulse which is divided into three sections and placed in period T1 (P1 to P5), period T4 (P20 to P23) and period T5 (P23 to P26). The waveform element constituting a small-dot drive pulse is divided into two sections and placed in period T2 (P5 to P8) and period T6 (P27 to P38). A waveform element constituting a middle-dot drive pulse is not divided and placed in period T3 (P9 to P20). A waveform element constituting a large-dot drive pulse is divided into two sections and placed in period T4 (P20 to P23) and period T7 (P39 to P246). Note that a waveform element in period T4 is commonly used as the large-dot drive pulse and the fine-vibration pulse.

A first connection element (P8 to P9) is placed in period TS1 between period T2 and period T3. A second connection element (P26 to P27) is placed in period TS2 between period T5 and period T6. A third connection element (P38 to p39) is placed in period TS3 between period T3 and period T4.

The control unit 12 develops print data into 10-bit print data. Specifically, development to print data is performed such that the uppermost bit corresponds to period T1, the second bit corresponds to period T2, the third bit corresponds to period TS1. Thus, the lowest bit corresponds to period T7. Therefore, as shown in FIG. 15, the control unit 12 generates print data (0000100001) corresponding to the nozzle orifice 19 for discharging the large ink droplet 44, print data (0001000000) corresponding to the nozzle orifice 19 for discharging the middle ink droplet 44, print data (0100000100) corresponding to the nozzle orifice 19 for discharging small ink droplet 44 and print data (1000110000) corresponding to nozzle orifice 19 which does not discharge any ink droplet 44.

The drive pulse generator (the shift register 62, the latch circuit 63, the level shifter 64 and the switch 65) selects, from the drive signal, the fourth waveform element in period T4 and the seventh waveform element in period T7 in accordance with print data (0000100001) for the large dot so as to generate a large-dot drive pulse. The drive pulse generator selects, the drive signal, the third waveform element in period T3 in accordance with print data (0001000000) for the middle dot so as to generate a middle-dot drive pulse. The drive pulse generator selects, from the drive signal, the second waveform element in period T2 and the sixth waveform element in period T6 in accordance with print data (0100000100) for the small dot so as to generate a small-dot drive pulse. The drive pulse generator selects, from the drive signal, the first waveform element in period T1, the fourth waveform element in period T4 and fifth waveform element in period T5 in accordance with print data (1000110000) for non-printing so as to generate a fine-vibration pulse.

Figure 15:
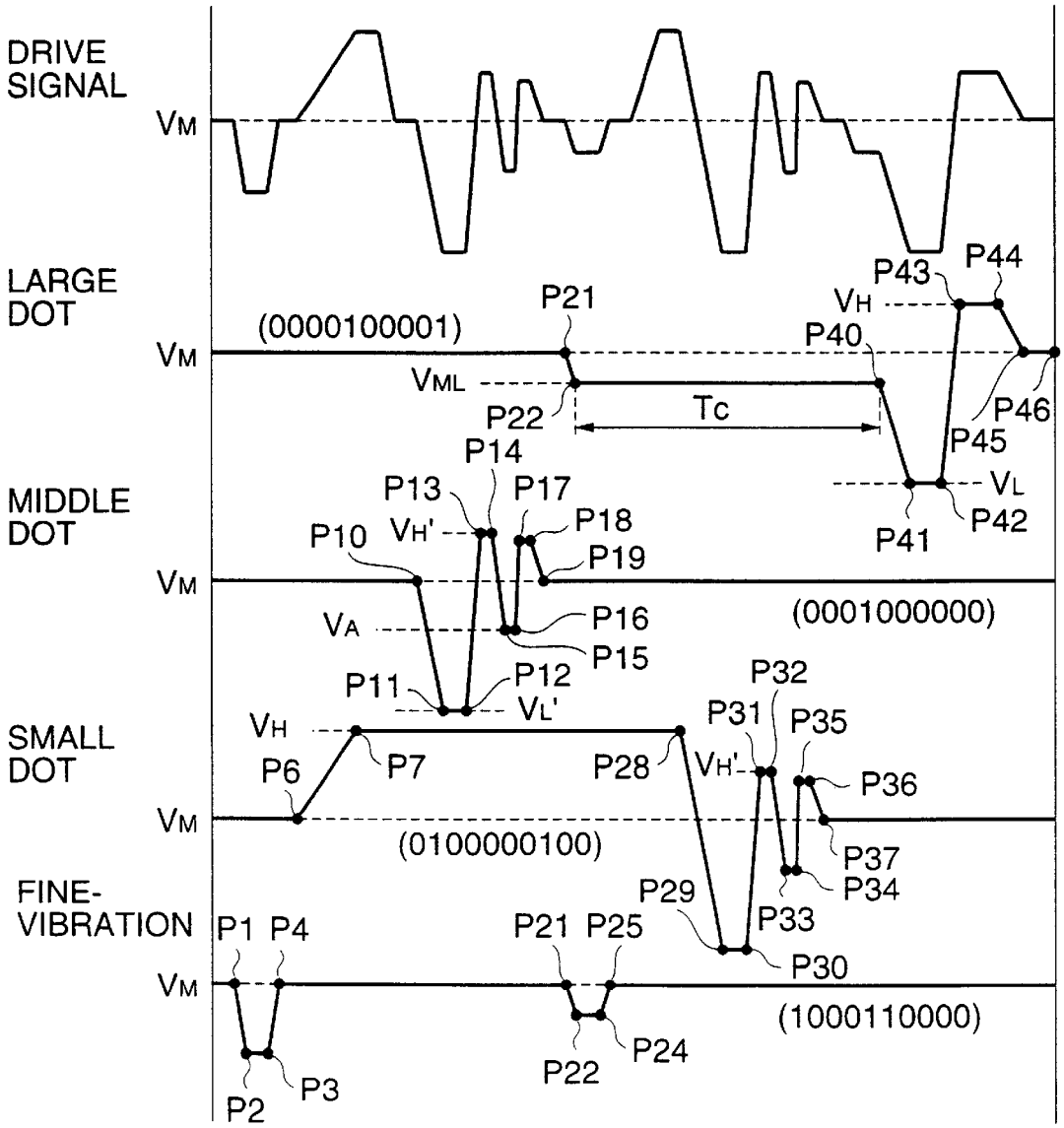
FIG. 15 is a diagram showing drive pulses generated from the drive signal of FIG. 14.

As shown in FIG. 15, the large-dot drive pulse is constituted by expansion waveform elements (P21 to P40) for somewhat expanding the pressure chamber 22 having a reference capacity to somewhat charge ink into the pressure chamber 22 and maintain for a predetermined time period; charge waveform elements (P40 to P42) for furthermore expanding the pressure chamber 22 expanded by the expansion waveform element; discharge waveform elements (P42 to P44) for rapidly raising the voltage from lowest voltage VL to second highest voltage VH' which is set to be somewhat lower than highest potential VH so as to discharge the ink droplet 44 from the nozzle orifices 19; and vibration preventive elements (P44 to P45) for preventing wave of the meniscus immediately after the discharge.

The middle-dot drive pulse is constituted by charge waveform elements (P10 to P12) for decreasing the voltage at a predetermined gradient from the intermediate voltage VM to second lowest voltage VL' set to be somewhat higher than the lowest potential VL so as to expand the pressure chamber 22; discharge waveform elements (P12 to P14) for contracting the expanded pressure chamber 22; introducing waveform elements (P14 to P16) for rapidly expanding the pressure chamber 22 immediately before a portion which is formed into the ink droplet 44 owing to supply of the discharge waveform element from the meniscus to introduce the meniscus into the pressure chamber 22; and vibration preventive waveform elements (P16 to P19) for preventing wave of the meniscus immediately after the discharge.

The small-dot drive pulse is constituted by contraction waveform elements (P6 to P28) for raising the voltage from the intermediate voltage VM to the highest voltage VH to somewhat contract the pressure chamber 22 and maintained the state of contraction; charge waveform elements (P28 to P30) for expanding the pressure chamber 22, the state of contraction of which has been maintained owing to the contraction waveform elements, so as to charge ink; discharge waveform elements (P30 to P32) for contracting the expanded pressure chamber 22; introduction waveform elements (P32 to P34) for rapidly expanding the pressure chamber 22 immediately before a portion which is formed into the ink droplet 44 owing to supply of the discharge waveform element from the meniscus to introduce the meniscus into the pressure chamber 22; and vibration preventive waveform elements (P34 to P37) for preventing wave of meniscus immediately after the discharge.

The fine-vibration pulse is constituted by first fine-vibration waveform elements (P1 to P4) and second fine-vibration waveform elements (P21 to P25).

When the large-dot drive pulse is supplied to the piezoelectric vibrator 21, the large ink droplet 44 can be ejected. When the middle-dot drive pulse is supplied to the piezoelectric vibrator 21, the middle ink droplet 44 can be ejected. When the small-dot drive pulse is supplied to the piezoelectric vibrator 21, the small ink droplet 44 can be ejected. When the fine-vibration pulse is supplied to the piezoelectric vibrator 21, ink adjacent to the nozzle orifice 19 is stirred.

In this embodiment, an operation for recording a color image is performed by using dye-family color ink such that the small ink droplet 44, the middle ink droplet 44 and the large ink droplet 44 are used. When a document or the like by using pigment-family black ink, the large ink droplet 44 is used. That is, different drive pulses are used between dye-family ink and pigment-family ink. The color image is recorded by using dots having a plurality of sizes so that a precise image having a large number of gray-scale levels is recorded. When a document is recorded, use of large dots is effective. As a result, the recording operation can be performed by using ink droplets 44 in proper quantities. It leads to a fact that the image quality can furthermore be improved. Moreover, the recording speed can be improved.

In this embodiment, the same drive signals are supplied to the unit color nozzle array Ns and the divided nozzle arrays Nd. As an alternative to this, individual drive signals may be supplied to the unit color nozzle array Ns and the divided nozzle arrays Nd.

In the third embodiment, the printer 1 incorporates the recording head 4 having two divided nozzle arrays Nd and one unit color nozzle array Ns so that the divided nozzle arrays Nd discharge dye-family ink color ink and the unit color nozzle array Ns discharges pigment-family ink black ink. The present invention is not limited to the foregoing structure. Another structure may be employed which incorporates a recording head 4 having a plurality of sets each having the divided nozzle arrays Nd and the unit color nozzle array Ns so that each set selectively discharges dye-family ink and pigment-family ink.

Figure 16:
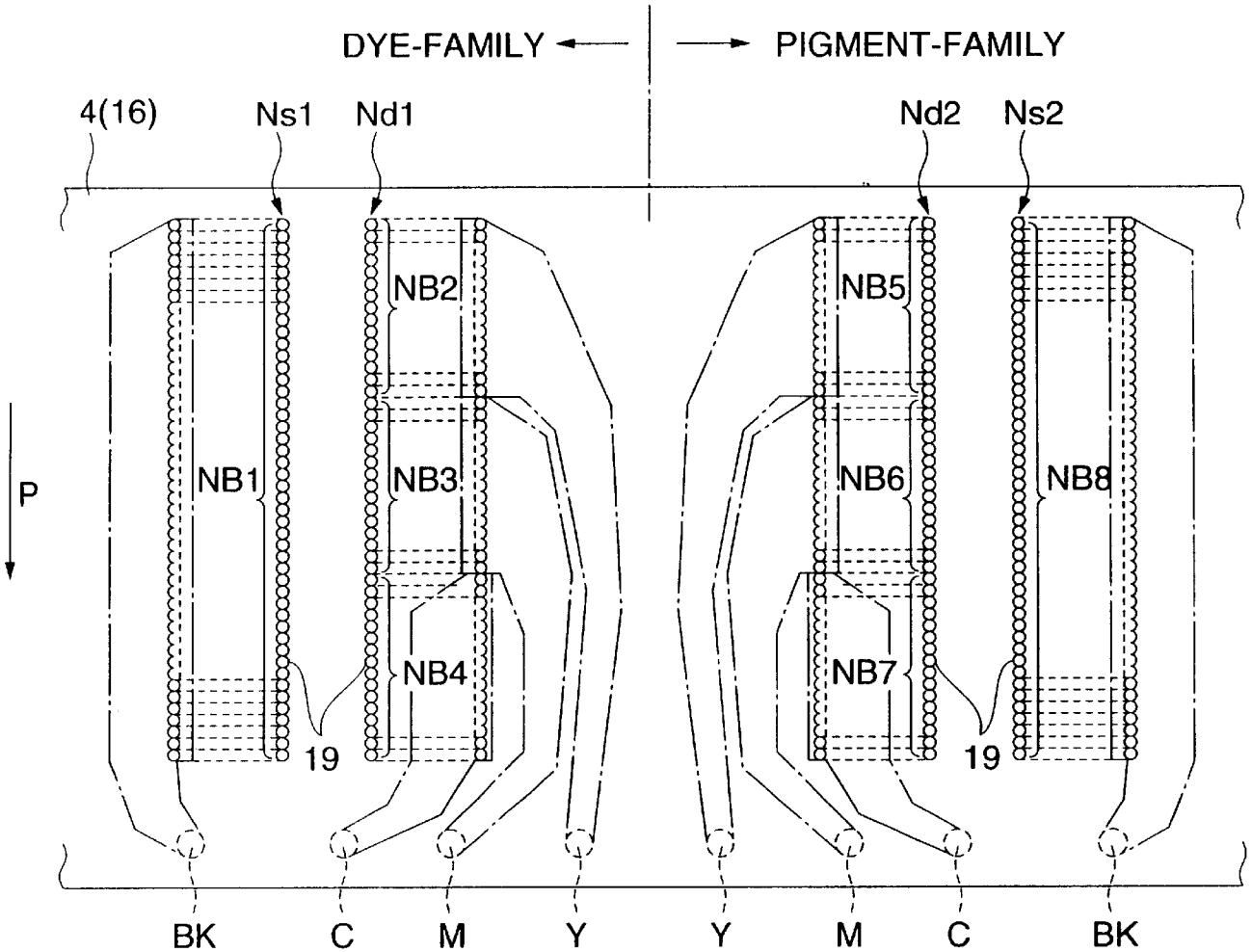
FIG. 16 is a diagram showing the structures of nozzle arrays of a recording head according to a fourth embodiment of the invention.

FIG. 16 is a diagram showing a fourth embodiment having the above-mentioned structure and a state when the recording head 4 is viewed from a portion adjacent to the nozzle plate 16.

The recording head 4 according to this embodiment incorporates four nozzle arrays which have a plurality of nozzle orifices 19 arranged in the sub-scanning direction in a line and which are, in parallel, arranged in the main scanning direction. The foregoing nozzle arrays consist of first single color nozzle arrays Ns1, first divided nozzle arrays Nd1, second divided nozzle arrays Nd2 and second single color nozzle arrays Ns2. The divided nozzle arrays Nd discharge color ink in different colors, the unit color nozzle array Ns discharges black ink.

That is, the first single color nozzle array Ns1 constituted by the single nozzle block (the first nozzle block NB1) discharges dye-family black ink. The first divided nozzle array Nd1 is equally divided into the second nozzle block NB2 disposed most upstream position in the paper feeding direction P, the third nozzle block NB3 disposed adjacent to the second nozzle block NB2 in the downstream direction and a fourth nozzle block NB4 disposed at the most downstream position. The second nozzle block NB2 discharges dye-family yellow ink, the third nozzle block NB3 discharges dye-family magenta ink and the fourth nozzle block NB4 discharges dye-family cyan ink.

Also the second divided nozzle array Nd2 is divided into three sections which include the fifth nozzle block NB5 disposed at the most upstream position in the paper feeding direction P; the sixth nozzle block NB6 adjacent to the fifth nozzle block NB5 in the downstream direction; and the seventh nozzle block NB7 disposed at the most downstream position. The fifth nozzle block NB5 discharges pigment-family yellow ink, the sixth nozzle block NB6 discharges pigment-family magenta ink and the seventh nozzle block NB7 discharges pigment-family cyan ink. The second single color nozzle array Ns2 constituted by the single nozzle block (the third nozzle block) discharges pigment-family black ink.

The structure according to this embodiment incorporates the nozzle arrays (the first single color nozzle array Ns1 and the first divided nozzle array Nd1) for discharging dye-family ink and the nozzle arrays (the second single color nozzle array Ns2 and the second divided nozzle array Nd2) for discharging pigment-family ink. Therefore, ink can selectively be used which is suitable to the image which must be recorded. Thus, a variety of images can be recorded to have high quality.

Figure 17:
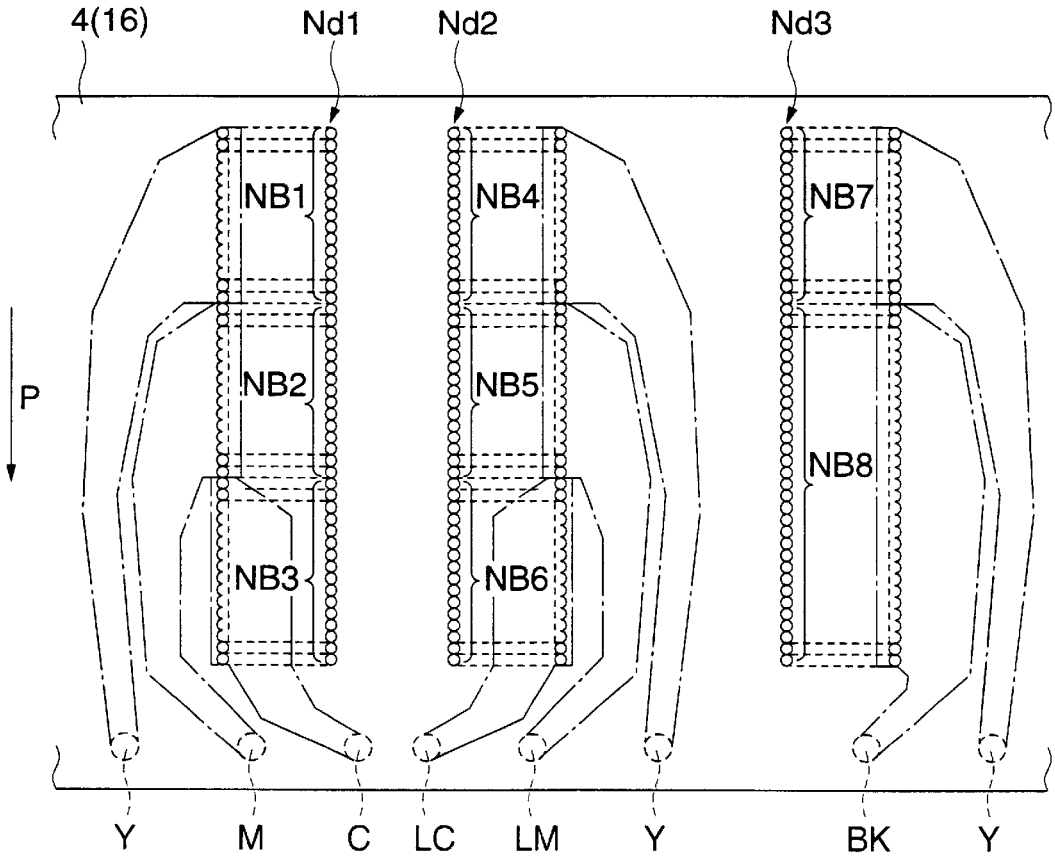
FIG. 17 is a diagram showing the structures of nozzle arrays of a recording head according to a fifth embodiment of the invention.

As shown in FIG. 17, all of the plural nozzle arrays may be constituted by divided nozzle arrays as a fifth embodiment of the invention. A recording head 4 shown in FIG. 17 incorporates three divided nozzle arrays arranged in the main scanning direction. The foregoing nozzle arrays consist of the first divided nozzle array Nd1, the second divided nozzle array Nd2 and a third divided nozzle array Nd3 when the nozzle arrays are viewed from a left-hand position in the drawing.

The first divided nozzle array Nd1 is equally divided into three nozzle blocks arranged in the paper feeding direction. That is, the first divided nozzle array Nd1 is divided into the first nozzle block NB1 disposed at the most upstream position in the paper feeding direction P, the second nozzle block NB2 adjacent to the first nozzle block NB1 in the downstream direction and the third nozzle block NB3 disposed at the most downstream position. The first nozzle block NB1 discharges dye-family yellow ink, the second nozzle block NB2 discharge dye-family magenta ink and the third nozzle block NB3 discharges dye-family cyan ink.

Also the second divided nozzle array Nd2 is divided into three nozzle blocks which include the fourth nozzle block NB4 disposed at the most upstream position in the paper feeding direction P, the fifth nozzle block NB5 disposed adjacent to the fourth nozzle block NB4 in the downstream direction and the sixth nozzle block NB6 disposed at the most downstream direction. The fourth nozzle block NB4 discharges dye-family yellow ink, the fifth nozzle block NB5 discharges dye-family light magenta ink and the sixth nozzle block NB6 discharges dye-family light cyan ink.

The third divided nozzle array Nd3 is divided into two nozzle blocks which are the seventh nozzle block NB7 disposed at the upstream position in the paper feeding direction P and an eighth nozzle block NB8 disposed at a downstream position. The third divided nozzle array Nd3 has the seventh nozzle block NB7 having a length which is about ⅓ of the nozzle array and arranged to discharge dye-family yellow ink. The eighth nozzle block NB8 has a length of about ⅔ of the nozzle array and capable of discharging pigment-family black ink.

In the foregoing structure, either of the nozzle blocks adjacent in the main scanning direction of the divided nozzle arrays Nd1 and Nd2 discharges ink in a dark color. The other nozzle block discharges ink in a light color of the same color as that of ink in the dark color. That is, the second nozzle block NB2 discharges magenta ink in the dark color. The fifth nozzle block NB5 adjacent to the second nozzle block NB2 discharges light magenta ink which is ink in the light color. Similarly, the third nozzle block NB3 discharges cyan ink which is ink in the dark color. The sixth nozzle block NB6 adjacent to the third nozzle block NB3 discharges light cyan ink which is ink in the light color.

When the foregoing structure is employed, a region in which ink in the dark color (or ink in the light color) has been recorded at the first main scan is a region in which ink in the light color of the same color (or ink in the dark color) is next overprinted. That is, overprinting with ink in the same color type is performed. Therefore, if ink is mixed, an influence on the image quality can satisfactorily be prevented. As a result, a color image having high quality can be recorded.

Figure 18:
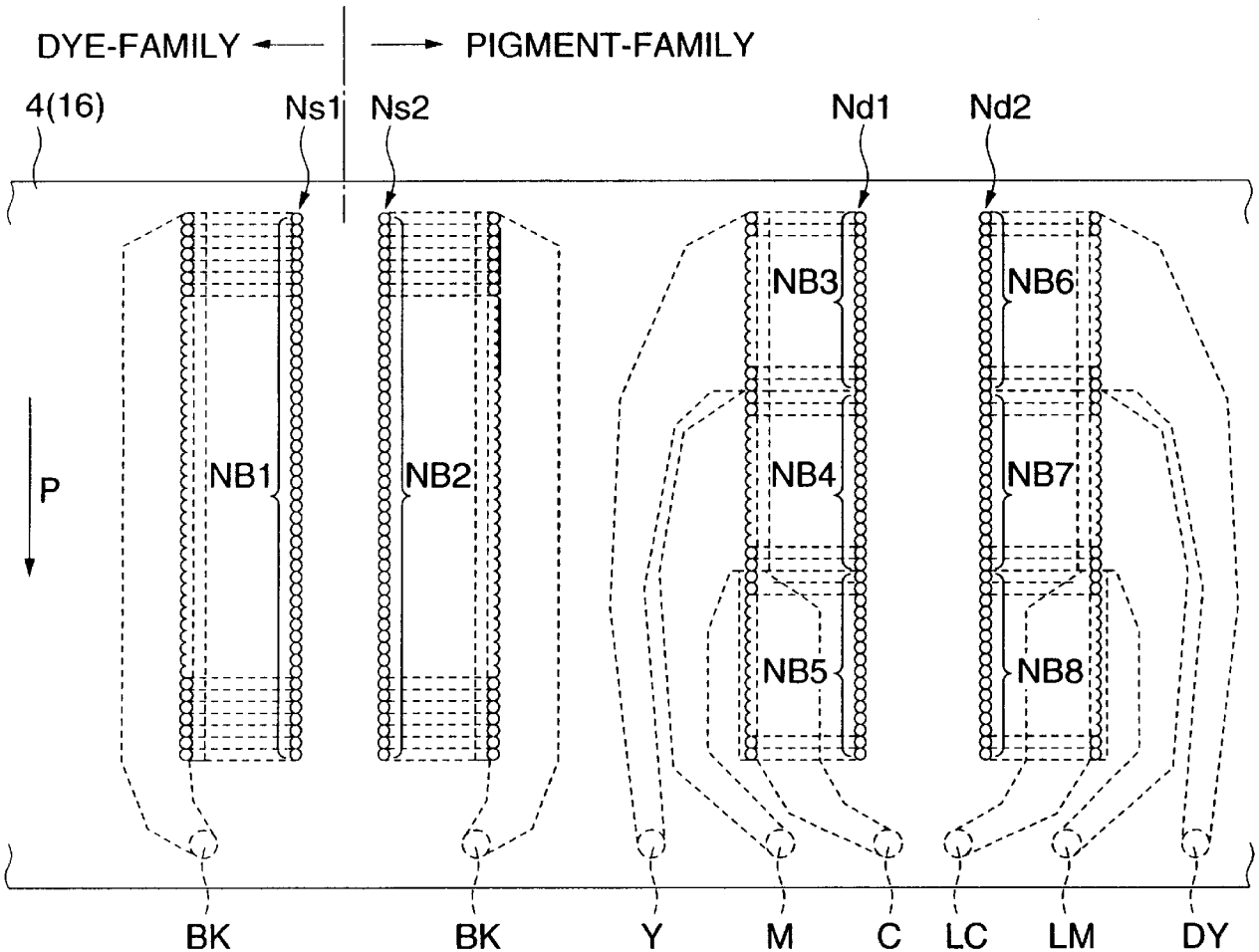
FIG. 18 is a diagram showing the structures of nozzle arrays of a recording head according to a sixth embodiment of the invention.

A structure as shown in FIG. 18 may be employed in which a plurality of black nozzle arrays are arranged adjacent to one another as a sixth embodiment of the invention. Moreover, at least one nozzle block constituting the divided nozzle array is a nozzle block for dark color ink.

The recording head 4 shown in FIG. 18 incorporate four nozzle arrays arranged in the main scanning direction. The nozzle arrays consisting of, when viewed from the left-hand position in FIG. 18, the first single color nozzle array Ns1, the second single color nozzle array Ns2, the first divided nozzle array Nd1 and the second divided nozzle array Nd2. The first divided nozzle array Nd1 and the second divided nozzle array Nd2 discharge color ink in different colors. The first single color nozzle arrays Ns1 and Ns2 discharge black ink.

That is, the first single color nozzle array Ns1 constituted by the single nozzle block (the first nozzle block NB1) discharges pigment-family black ink. The second single color nozzle array Ns2 constituted by the second nozzle block NB2 discharges dye-family black ink. The first divided nozzle array Nd1 is equally divided into the third nozzle block NB3 disposed at the most upstream position in the paper feeding direction P, the fourth nozzle block NB4 adjacent to the third nozzle block NB3 in the downstream direction and the fifth nozzle block NB5 disposed at the most downstream position. The third nozzle block NB3 discharges yellow ink, the fourth nozzle block NB4 discharges dye-family magenta ink and the fifth nozzle block NB5 discharges dye-family cyan ink.

Also the second divided nozzle array Nd2 is divided into three nozzle blocks consisting of the sixth nozzle block NB6 disposed at the most upstream position in the paper feeding direction P, the seventh nozzle block NB7 adjacent to the sixth nozzle block NB6 in the downstream direction and the eighth nozzle block NB8 disposed at the most downstream position. The sixth nozzle block NB6 discharges dye-family dark yellow ink, the seventh nozzle block NB7 discharges dye-family light magenta ink and the eighth nozzle block NB8 discharges dye-family light cyan ink.

Dark yellow ink is yellow ink which is darker than yellow ink and which is dark color ink similar to dark magenta ink and dark cyan ink. Dark color ink, such as dark yellow ink, is used to impart gray scale to so-called composite black (black realized by mixing yellow ink, cyan ink and magenta ink). When dark color ink above is used, an image exhibiting natural color can be formed.

The recording head 4 having the above-mentioned structure is arranged such that the first single color nozzle array Ns1 for discharging dye-family black ink and the second single color nozzle array Ns2 for discharging pigment-family black ink are disposed adjacent to each other. Therefore, color mixture of black ink and color ink can effectively be prevented. Moreover, the second single color nozzle array Ns2 for dye-family ink is disposed adjacent to the color ink portion (adjacent to the first divided nozzle array Nd1). Therefore, color mixture of black ink and color ink can reliably be prevented.

Figure 19:
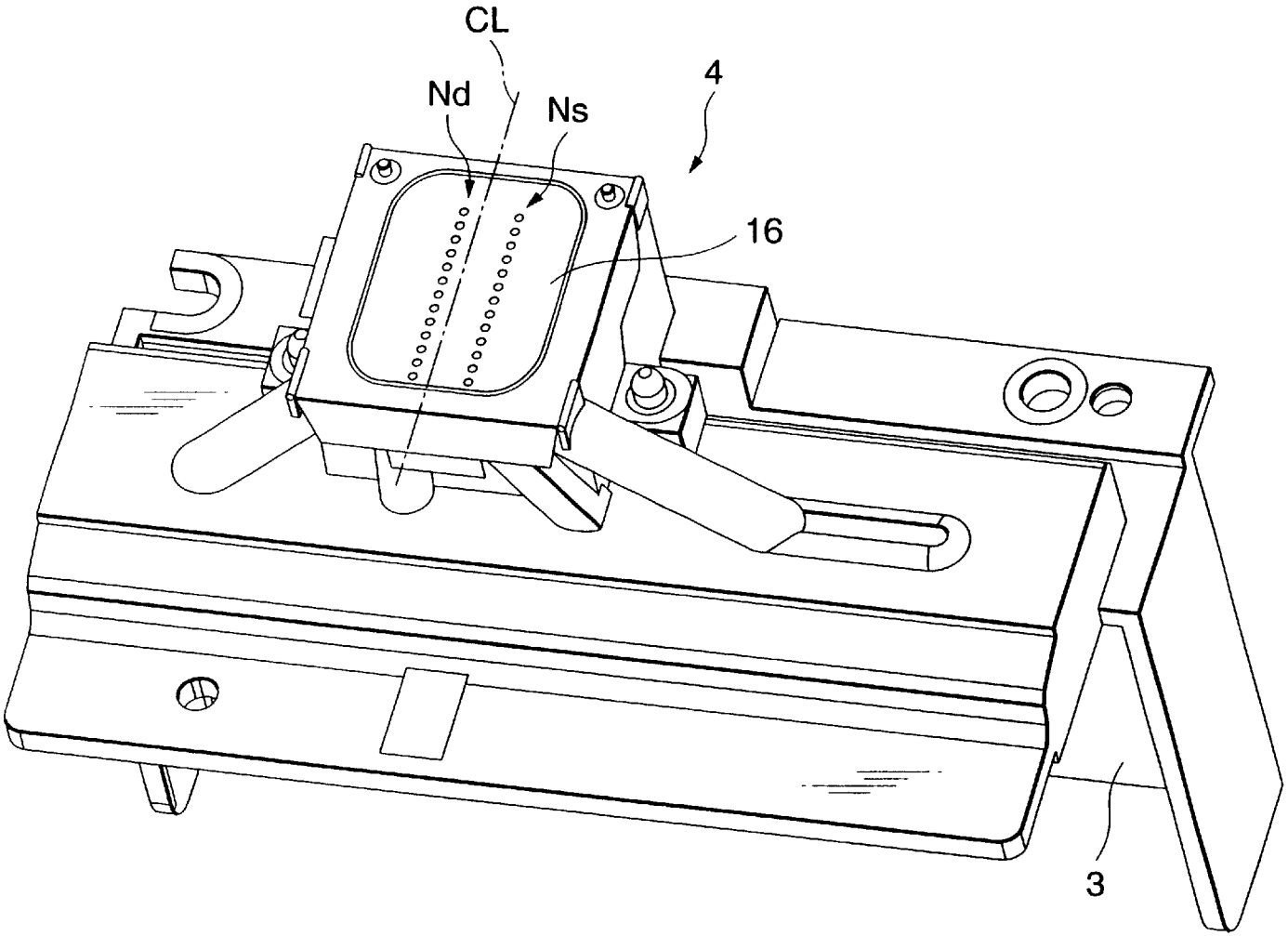
FIG. 19 is a perspective view showing the structures of nozzle arrays of a recording head according to a seventh embodiment of the invention.

The present invention may be applied to a recording head 4 which incorporates one black nozzle array and one color nozzle array, as shown in FIG. 19 as a seventh embodiment.

The recording head 4 incorporates two nozzle arrays arranged in the main scanning direction. The left-hand nozzle array in FIG. 19 is the divided nozzle arrays Nd and the right-hand nozzle array is the unit color nozzle array Ns. The unit color nozzle array Ns is divided into three nozzle blocks in the direction of the nozzle array. The type of ink is assigned to each of the nozzle blocks. For example, the unit color nozzle array Ns incorporating the single nozzle block discharges pigment-family black ink. The nozzle blocks constituting the divided nozzle arrays Nd discharge yellow ink, magenta ink and cyan ink which are dye-family color ink. That is, the divided nozzle arrays Nd serve as the color nozzle arrays. The unit color nozzle array Ns serves as the black nozzle array.

The recording head 4 has a structure that the position of the unit color nozzle array Ns on the bottom surface of the recording head 4 (the surface of the nozzle plate 16) with respect to central line CL in the main scanning direction and the position of the divided nozzle array Nd are asymmetrical. Specifically, the divided nozzle arrays Nd are formed more adjacent to the central line CL as compared with the unit color nozzle array Ns. The reason for this lies in that the passage for each ink which is supplied to the divided nozzle arrays Nd can easily be formed. That is, the divided nozzle arrays Nd is disposed adjacent to the central line CL so that the area of the region of the divided nozzle arrays Nd opposite to the central line CL is enlarged.

The present invention is not limited to the foregoing structure. A variety of modifications are permitted. For example, each of the embodiment incorporates the recording head 4 which uses ink solutions which are different in the permeation into the recording paper 13. The difference is not limited to the permeation. For example, a variety of ink solutions may be employed which are different in the physical properties, such as the viscosity and the density.

Dummy nozzle orifices 19' which do not concern discharge of the ink droplet 44 may be formed at the two ends of the divided nozzle arrays Nd or the nozzle block NB. When the foregoing structure is employed, the nozzle orifices 19 at the two ends which frequently instably discharge ink droplets 44 are not used. Therefore, the image quality can furthermore be improved. Moreover, adjacent crosstalk from another nozzle block adjacent in the sub-scanning direction can be prevented.

A structure may be employed in which three or more nozzle arrays are disposed. Moreover, another nozzle array is disposed between the divided nozzle arrays Nd which incorporates at least the yellow block for discharging yellow ink and the unit color nozzle array Ns (the black nozzle array) for discharging black ink. For example, the first divided nozzle array Nd1 is light-color nozzle array for discharging yellow ink, light magenta ink and light cyan ink. Moreover, the unit color nozzle array Ns is the black nozzle array. The second divided nozzle array Nd2 which is disposed between the light-color nozzle array and the black nozzle array is the dark-color nozzle array for discharging magenta ink and cyan ink. When the foregoing structure is employed, time required for yellow ink to permeate the recording paper 13 can be maintained. Thus, mixture of yellow ink and black ink can be prevented. As a result, the image quality can be improved.

Another structure may be employed in which a plurality of the unit color nozzle arrays Ns are provided. Moreover, the nozzle orifices 19 are formed between the unit color nozzle arrays Ns in the zigzag configuration. Thus, ink in the same color is ejected from the unit color nozzle arrays Ns. When the foregoing structure is employed, the resolution of ink which is ejected from the unit color nozzle array Ns can substantially be raised in the sub-scanning direction. Thus, the image quality can furthermore be improved.

As for the number of the nozzle blocks constituting the divided nozzle array, one nozzle array may be constituted by four or more nozzle blocks to obtain a similar effect.

Although the ink jet recording head 4 has been described as the liquid jetting apparatus, the present invention is not limited to the foregoing recording head 4. The present invention may be applied to an industrial liquid jetting apparatus and a commercial liquid jetting apparatus. The present invention may be applied to, for example, an apparatus for jetting glue or manicure having viscosity higher than that of ink.

In addition to the ink ejection control program, a waveform data for defining a waveform of the drive signal, and liquid-kind information indicating a liquid-kind corresponding to the waveform data may be recorded in the memory card 66 in order to generate plural kinds of drive signals from the drive signal generator 42, each having a waveform different from one another, based on the waveform data.

The control unit 12 may be configured so as to serve as a liquid kind recognizer for recognizing respective kinds of liquid ejected from the first and second black nozzle arrays Nk1, Nk2 (the first nozzle group), the third black nozzle array Nk3 (the second nozzle group) and the color nozzle arrays Ny, Nm, Ncy (the third nozzle group); a drive waveform selector for selecting an optimum waveform of the drive signal in accordance with the respective kinds of the ejected ink; and an ejection controller for ejecting ink drops from nozzle arrays which correspond to the drive waveform selected by the drive waveform selector.

Similarly, with regard to the printer 1 comprising the recording head 4 having the plural nozzle blocks (i.e. NB1 to NB8), the drive signal generator 42 may be configured such that plural kinds of drive signals are generated therefrom, each having a waveform different from one another, based on the waveform data. And the control unit 12 may be configured so as to serve as a liquid kind recognizer for recognizing respective kinds of liquid ejected from each nozzle block; a drive waveform selector for selecting an optimum waveform of the drive signal in accordance with the respective kinds of the ejected ink; and an ejection controller for ejecting ink drops from nozzle arrays which correspond to the drive waveform selected by the drive waveform selector.

In the above configuration, properly inserting a different memory card 66 in which a different waveform data and different liquid-kind information are recorded into the recording medium holder 67, the apparatus can deal with various combinations of the liquid-kinds.

What is claimed is:

1. A liquid jetting apparatus for jetting a first kind of liquid droplet having a first permeability value and a second kind of liquid droplet having a second permeability value different from the first permeability value, the liquid jetting apparatus comprising:

a liquid jetting head;

a first group of nozzles, provided with the liquid jetting head for respectively ejecting the first kind of liquid droplet; and a second group of nozzles, provided with the liquid jetting head for respectively ejecting the second kind of liquid droplet, wherein the amount of each liquid droplet ejected from the nozzle in the first group and the amount of each liquid droplet ejected from the nozzle in the second group are different from each other.

2. The liquid jetting apparatus as set forth in claim 1, wherein the nozzles in the first group include a plurality of nozzle arrays.

3. An image recording apparatus for recording an ink image on a recording medium, comprising the liquid jetting apparatus as set forth in claim 1, wherein the first kind of liquid is a first kind of ink and the second kind of liquid is a second kind of ink.

4. The image recording apparatus as set forth in claim 3, wherein the first kind of ink includes a pigment-family ink and the second kind of ink includes a dye-family ink.

5. The image recording apparatus as set forth in claim 4, wherein the pigment-family ink is a black ink and the dye-family ink is a colored ink.

6. The image recording apparatus as set forth in claim 3, further comprising a capping member for sealing a surface on which the nozzles are formed, wherein the capping member is partitioned in accordance with the kind of ink ejected from the nozzles to be sealed.

7. A computer-readable recording medium for recording a control program to cause a computer to function as:

a liquid-kind recognizer for recognizing respective ink kinds ejected from the nozzles in the first group and the second group of the liquid jetting apparatus as set forth in claim 1;

a drive waveform selector for selecting a waveform of a drive signal for driving the liquid jetting apparatus to eject the liquid droplet, which is optimum with respect to each ink kind recognized by the liquid-kind recognizer; and an ejection controller for ejecting the liquid droplet using the drive signal selected by the drive waveform selector.

8. A liquid jetting apparatus comprising:

a liquid jetting head; and a plurality of nozzle arrays, provided with the liquid jetting head, the nozzle arrays including at least one first nozzle array which is divided into a plurality of nozzle blocks to form divided nozzle arrays, and at least one second nozzle array which is not divided into a plurality of nozzle blocks, wherein a liquid ejected from the first nozzle array has a first permeability value and a liquid ejected from the second nozzle array has a second permeability value different from the first permeability value; and wherein the amount of each liquid droplet ejected from the nozzle in the first group and the amount of each liquid droplet ejected from the nozzle in the second group are different from each other.

9. The liquid jetting apparatus as set forth in claim 8, wherein at least two divided nozzle arrays are formed from at least two of the nozzle arrays.

10. The liquid jetting apparatus as set forth in claim 9, wherein the nozzles in one nozzle array including the divided nozzle arrays are arranged so as to form a zigzag configuration with respect to the nozzles in another nozzle array including the divided nozzle arrays.

11. An image recording apparatus for recording an ink image on a recording medium, comprising the liquid jetting apparatus as set forth in claim 9, wherein the liquid ejected from a divided nozzle array in one nozzle array is a first kind of ink, and the liquid ejected from a divided nozzle array in another nozzle array adjacent to the divided nozzle array for ejecting the first kind of ink is a second kind of ink;

wherein the first kind of ink and the second kind of ink are monchromatic; and wherein the first kind of ink has a higher color density than the second kind of ink.

12. The image recording apparatus as set forth in claim 11, further comprising a capping member for sealing a surface on which the nozzles are formed, wherein the capping member is partitioned in accordance with the kind of ink ejected from the nozzles to be sealed.

13. The liquid jetting apparatus as set forth in claim 8, wherein both ends of the respective nozzle blocks are dummy nozzles which are not subjected to the liquid ejection.

14. The liquid jetting apparatus as set forth in claim 8, further comprising pressure chambers for generating pressure to eject the liquid from the associated nozzles; and a dummy pressure chamber which is not subjected to the liquid ejection is provided between the nozzle blocks in the respective adjacent divided nozzle arrays.

15. The liquid jetting apparatus as set forth in claim 8, wherein at least one of the nozzle arrays is not divided into the divided nozzle arrays.

16. The liquid jetting apparatus as set forth in claim 15, wherein at least two of the nozzle arrays are not divided into the divided nozzle arrays; and wherein the nozzles in one nozzle array not including the divided nozzle arrays are arranged so as to form a zigzag configuration with respect to the nozzles in another nozzle array not including the divided nozzle arrays.

17. An image recording apparatus for recording an ink image on a recording medium, comprising the liquid jetting apparatus as set forth in claim 15, wherein the divided nozzle array ejects either one of a first kind of ink or a second kind of ink having a higher permeability with respect to the recording medium than the first kind of ink; and wherein the respective nozzle arrays not including the divided nozzle array eject another one of the first kind of ink and the second kind of ink.

18. The image recording apparatus as set forth in claim 17, wherein at least one of the nozzle arrays not including the divided nozzle arrays ejects a black ink droplet.

19. The image recording apparatus as set forth in claim 17, wherein at least one nozzle array is arranged between the nozzle array for ejecting the black ink droplet and a nozzle array including a divided nozzle arrays for ejecting a yellow ink droplet.

20. The image recording apparatus as set forth in claim 17, wherein the first kind of ink includes a pigment-family ink and the second kind of ink includes a dye-family ink.

21. The image recording apparatus as set forth in claim 20, wherein the pigment-family ink is a black ink and the dye-family ink is a colored ink.

22. The image recording apparatus as set forth in claim 17, further comprising a capping member for sealing a surface on which the nozzles are formed, wherein the capping member is partitioned in accordance with the kind of ink ejected from the nozzles to be sealed.

23. An image recording apparatus for recording an ink image on a recording medium, comprising the liquid jetting apparatus as set forth in claim 8, wherein the at least one divided nozzle comprises a first divided nozzle block for ejecting a yellow ink droplet, a second divided nozzle block for ejecting a magenta ink droplet and a third nozzle block for ejecting a cyan ink droplet.

24. The image recording apparatus as set forth in claim 23, wherein the second nozzle block is arranged between the first nozzle block and the third nozzle block.

25. The image recording apparatus as set forth in claim 23, further comprising a capping member for sealing a surface on which the nozzles are formed, wherein the capping member is partitioned in accordance with the kind of ink ejected from the nozzles to be sealed.

26. The recording apparatus as set forth in claim 8, wherein the first kind of ink includes a pigment-family ink and the second kind of ink includes a dye-family ink.

27. The image recording apparatus as set forth in claim 26, wherein the pigment-family ink is a black ink and the dye-family ink is a colored ink.

28. The image recording apparatus as set forth in claim 8, further comprising a capping member for sealing a surface on which the nozzles are formed, wherein the capping member is partitioned in accordance with the kind of ink ejected from the nozzles to be sealed.

29. A computer-readable recording medium for recording a control program to cause a computer to function as:

a liquid-kind recognizer for recognizing respective ink kinds ejected from the nozzles in each nozzle block of the liquid jetting apparatus as set forth in claim 8;

a drive waveform selector for selecting a waveform of a drive signal for driving the liquid jetting apparatus to eject the liquid droplet, which is optimum with respect to each ink kind recognized by the liquid-kind recognizer; and an ejection controller for ejecting the liquid droplet using the drive signal selected by the drive waveform selector.

30. A liquid jetting apparatus comprising:

a first group of nozzles for respectively ejecting a first kind of liquid droplet having a physical property having a first value;

a second group of nozzles for respectively ejecting the first kind of liquid droplet having the physical property having the first value; and a third group of nozzles for respectively ejecting a second kind of liquid droplet having the physical property having a second value different from the first value, wherein the physical property is a property other than color, wherein the amount of liquid droplet ejected from the nozzle in the first group and the amount of liquid droplet ejected from the nozzle in the second group are different from each other, wherein the first kind of liquid is a first kind of ink and the second kind of liquid is a second kind of ink, and wherein the second kind of ink has a higher permeability with respect to the recording medium than the first kind of ink.

31. The liquid jetting apparatus as set forth in claim 31, wherein the nozzles in the second group and a third group respectively include at least one nozzle array; and wherein the nozzle array in the second group and the nozzle array in the third group are arranged adjacent to one another.

32. A computer-readable recording medium for recording a control program to cause a computer to function as:

a liquid-kind recognizer for recognizing respective ink kinds ejected from the nozzles in the first, second and third groups of the liquid jetting apparatus as set forth in claim 30;

a drive waveform selector for selecting a waveform of a drive signal for driving the liquid jetting apparatus to eject the liquid droplet, which is optimum with respect to each ink kind recognized by the liquid-kind recognizer; and an ejection controller for ejecting the liquid droplet using the drive signal selected by the drive waveform selector.

33. An image recording apparatus for recording an ink image on a recording medium, comprising the liquid jetting apparatus as set forth in claim 30, wherein the first kind of liquid is a first kind of ink and the second kind of liquid is a second kind of ink.

34. The image recording apparatus as set forth in claim 33, wherein the first kind of ink includes a pigment-family ink and the second kind of ink includes a dye-family ink.

35. The image recording apparatus as set forth in claim 34, wherein the pigment-family ink is a black ink and the dye-family ink is a colored ink.

36. The image recording apparatus as set forth in claim 33, further comprising a capping member for sealing a surface on which the nozzles are formed, wherein the capping member is partitioned in accordance with the kind of ink ejected from the nozzles to be sealed.

37. A method of driving a liquid jetting apparatus having nozzles, comprising the steps of:

defining a first group of nozzles for respectively ejecting a first kind of liquid droplet having a first permeability value;

defining a second group of nozzles for respectively ejecting the first kind of liquid droplet having the first permeability value;

defining a third group of nozzles for respectively ejecting a second kind of liquid droplet having a second permeability value different from the first permeability value; and setting the amount of liquid droplet ejected from the nozzle in the first group so as to be different from the amount of liquid droplet ejected from the nozzle in the second group.

38. The driving method as set forth in claim 37, further comprising the step of setting permeabilities with respect to an object to which the liquid is jetted of the first kind of liquid and the second kind of liquid so as to be different from each other.

39. The driving method as set forth in claim 38, wherein the amount of liquid droplet ejected from the nozzle in the first group is greater than the amount of liquid droplet ejected from the nozzle in the second group.

40. A method of driving a liquid jetting apparatus having nozzles, comprising the steps of:

defining a first group of nozzles for respectively ejecting a first kind of liquid droplet having a physical property having a first value;

defining a second group of nozzles for respectively ejecting the first kind of liquid droplet having the physical property having the first value;

defining a third group of nozzles for respectively ejecting a second kind of liquid droplet having the physical property having a second value different from the first value, wherein the physical property is a property other than color; and setting the amount of liquid of liquid droplet ejected from the nozzle in the first group so as to be different from the amount of liquid droplet ejected from the nozzle in the second group, wherein the first nozzle group and the second nozzle group are used when only the first kind of liquid is ejected; and the second nozzle group and the third nozzle group are used when both of the first kind of liquid and the second of liquid are ejected.

41. A method of driving a liquid jetting apparatus having nozzles, comprising the steps of:

defining a first group of nozzles for respectively ejecting a first kind of liquid droplet having a physical property having a first value;

defining a second group of nozzles for respectively ejecting the first kind of liquid droplet having the physical property having the first value;

defining a third group of nozzles for respectively ejecting a second kind of liquid droplet having the physical property having a second value different from the first value, wherein the physical property is other than color; and setting the amount of liquid droplet ejected from the nozzle in the first group so as to be different from the amount of liquid droplet ejected from the nozzle in the second group, wherein the third nozzle group includes a plurality of nozzle arrays; and wherein the second kind of liquid includes a plurality kinds of liquids having physical properties that are different with each other, which are allocated with respect to the respective nozzle arrays.

42. A computer-readable recording medium for recording a program to cause a computer to function as:

a first ejection controller for controlling a liquid jetting apparatus comprising a first group of nozzles and a second group of nozzles for jetting a first kind of liquid droplet having a first permeability value and a third group of nozzles for jetting a second kind of liquid droplet having a second permeability value different from the first permeability value such that the amount of liquid droplet ejected from the nozzle in the first group and the amount of liquid droplet ejected from the nozzle in the second group are different from each other.

43. The recording medium as set forth in claim 42, wherein the amount of liquid droplet ejected from the nozzle in the first group is greater than the amount of liquid droplet ejected from the nozzle in the second group.

44. The recording medium as set forth in claim 42, further causing the computer to function as:

a second ejection controller for controlling the liquid jetting apparatus such that the nozzles in the first and second groups are used when only the first kind of liquid is ejected; and the nozzles in the second and third groups are used when the first and second kinds of liquids are ejected and the nozzles in the first group are not used when both of the first and second kinds of liquids are ejected, wherein the computer is caused to function as at least one of the first ejection controller and the second ejection controller.

45. A method of driving a liquid jetting apparatus having nozzles, comprising the steps of:

defining a first group of nozzles in a liquid jetting head for respectively ejecting a first kind of liquid droplet having a first permeability value;

defining a second group of nozzles in a liquid jetting head for respectively ejecting a second kind of liquid droplet having a second permeability value different from the first permeability value; and setting the amount of each liquid droplet ejected from the nozzle in the first group so as to be different from the amount of each liquid droplet ejected from the nozzle in the second group.

46. A computer-readable recording medium for recording a program to cause a computer to function as:

an ejection controller for controlling a liquid jetting apparatus comprising a liquid jetting head which includes a first group of nozzles for jetting a first kind of liquid droplet having a first permeability value and a second group of nozzles for jetting a second kind of liquid droplet having a second permeability value different from the first permeability value, such that the amount of each liquid droplet ejected from the nozzle in the first group and the amount of each liquid droplet ejected from the nozzle in the second group are different from each other.

47. A method of driving a liquid jetting apparatus having nozzles, comprising the steps of:

defining at least one first nozzle array which is divided into a plurality of nozzle blocks for respectively ejecting a first kind of liquid droplet having a first permeability value;

defining at least one second nozzle array which is not divided into a plurality of nozzle blocks for respectively ejecting a second kind of liquid droplet having a second permeability value different from the first permeability value;

setting the amount of each liquid droplet ejected from the nozzle in the first nozzle array so as to be different from the amount of each liquid droplet ejected from the nozzle in the second nozzle array.

48. A computer-readable recording medium for recording a program to cause a computer to function as:

an ejection controller for controlling a liquid jetting apparatus comprising a liquid jetting head which includes at least one first nozzle array which is divided into a plurality of nozzle blocks for respectively ejecting a first kind of liquid droplet having a first permeability value, and at least one second nozzle array which is not divided into a plurality of nozzle blocks for respectively ejecting a second kind of liquid droplet having a second permeability value different from the first permeability value, such that the amount of each liquid droplet ejected from the nozzle in the first nozzle array and the amount of each liquid droplet ejected from the nozzle in the second nozzle array are different from each other.

* * * * *